US011812534B2

(12) United States Patent
Böhnel et al.

(10) Patent No.: US 11,812,534 B2
(45) Date of Patent: Nov. 7, 2023

(54) TRANSCEIVER FOR EMULATING AN INPUT DEVICE OF A LIGHTING SYSTEM

(71) Applicant: ZUMTOBEL LIGHTING GMBH, Dornbirn (AT)

(72) Inventors: Michael Böhnel, Dornbirn (AT); Thomas Steffens, Dornbirn (AT)

(73) Assignee: Zumtobel Lighting GmbH, Dornbirn (AT)

( * ) Notice: Subject to any disclaimer, the term of this patent is extended or adjusted under 35 U.S.C. 154(b) by 0 days.

(21) Appl. No.: 17/765,147

(22) PCT Filed: Dec. 8, 2020

(86) PCT No.: PCT/EP2020/085053
§ 371 (c)(1),
(2) Date: Mar. 30, 2022

(87) PCT Pub. No.: WO2021/130011
PCT Pub. Date: Jul. 1, 2021

(65) Prior Publication Data

US 2022/0346210 A1 Oct. 27, 2022

(30) Foreign Application Priority Data

Dec. 27, 2019 (EP) ..... 19219771

(51) Int. Cl.
*H05B 47/18* (2020.01)
*H05B 47/195* (2020.01)

(52) U.S. Cl.
CPC ..... *H05B 47/18* (2020.01); *H05B 47/195* (2020.01)

(58) Field of Classification Search
CPC ..... H05B 47/18; H05B 47/195; H05B 47/19
See application file for complete search history.

(56) References Cited

U.S. PATENT DOCUMENTS 9,894,740 B1 2/2018 Liszt et al.
2013/0264971 A1 10/2013 Yeh et al.
(Continued)

FOREIGN PATENT DOCUMENTS

EP 2512209 10/2012

OTHER PUBLICATIONS

PCT/EP2020/085053, International Search Report and Written Opinion dated Feb. 3, 2021, 14 pages.
(Continued)

*Primary Examiner* — Daniel D Chang
(74) *Attorney, Agent, or Firm* — Andrus Intellectual Property Law, LLP

(57) ABSTRACT

The present invention provides a transceiver (1) for a local lighting system (L1), preferably a local lighting system based on the DALI-2 industry standard, comprising a bus (2) and a control unit (3) electrically connected to the bus (2) for controlling communication via the bus (2). The transceiver (1) comprises a transmitter (1*a*) configured to transmit wireless signals to a global lighting system (14) comprising one or more luminaires (L2 . . . LN), a receiver (1*b*) configured to receive wireless signals from the global lighting system (14), and a processing unit (1*c*) configured to process the received wireless signals from the global lighting system (14). The processing unit (1*c*) of the transceiver (1) is configured to convert the received wireless signals into bus signals such that the transceiver (1) behaves as an input device of the local lighting system (L1) when electrically connected to the bus (2).

22 Claims, 4 Drawing Sheets

(56) References Cited

U.S. PATENT DOCUMENTS

| | | | | |
|---|---|---|---|---|
| 2015/0130365 | A1* | 5/2015 | Kim | H05B 47/18 315/294 |
| 2015/0220428 | A1 | 8/2015 | Simonyi et al. | |
| 2016/0286628 | A1 | 9/2016 | Cho et al. | |
| 2019/0069375 | A1* | 2/2019 | Baker | H04N 21/43635 |

OTHER PUBLICATIONS

Hua Yang et al., "A Swarm-Intelligence-Based Protocol for Data Acquisition in Networks with Mobile Sinks", IEEE Transactions on Mobile Computing, IEEE Service Center, Los Alamitos, CA, UA, vol. 7, No. 8, Aug. 1, 2008, pp. 931-945.

* cited by examiner

TRANSCEIVER FOR EMULATING AN INPUT DEVICE OF A LIGHTING SYSTEM

CROSS-REFERENCE TO RELATED APPLICATION

The present application is the U.S. national stage application of international application PCT/EP2020/085053 filed Dec. 8, 2020, which international application was published on Jul. 1, 2021 as International Publication WO 2021/130011 A1. The international application claims priority to European Patent Application No. 19219771.3 filed Dec. 27, 2019.

FIELD OF THE INVENTION

The present invention relates to a transceiver for a local lighting system, such as a single luminaire or a lighting of a building, to a luminaire comprising such a transceiver, to a lighting system comprising such a luminaire and at least one further luminaire as well as to a method for operating such a transceiver. The present invention in particular relates to a transceiver for a local lighting system based on the DALI-2 industry standard, as well as a luminaire based on the DALI-2 industry standard.

BACKGROUND OF THE INVENTION

In the prior art, lighting systems for providing illumination for example within a building are well known. A single luminaire, such as a ceiling lamp, desk lamp, free-standing lamp, wall lamp etc., may be an example of a lighting system. Members/components of a lighting system may communicate with each other in order to provide illumination based on changes in the environment of the lighting system or commands input to the lighting system from extern by a user. Examples of members/components of a lighting system comprise a control unit, lighting means, a lighting means driver for electrically supplying the lighting means and input devices for providing information about the environment of the lighting system and/or inputting commands to the lighting system from extern by a user.

For a communication between the members of the lighting system, a bus may be provided and the members may communicate with each other via the bus using a set of predefined bus signals and a bus protocol.

Often a user wants to add a new luminaire (local lighting system) to an existing lighting system (global lighting system) comprising one or more luminaires. In such a case, the new luminaire may not be compatible with the existing lighting system. For example, the communication between the components/members of the new luminaire may be via a bus (bus communication), whereas the one or more luminaires of the existing lighting system may only be configured for a wireless communication and not for a communication via the bus of the new luminaire. The new luminaire may correspond to a local lighting system wherein the existing lighting system corresponds to a global lighting system.

SUMMARY OF THE INVENTION

Therefore, it is an object of the present invention to provide a transceiver that allows incorporating a local lighting system into a global lighting system; in particular, that allows a communication between the local lighting system and the global lighting system.

These and other objects, which become apparent upon reading the following description, are solved by the subject-matter of the independent claim. The dependent claims refer to preferred embodiments of the invention.

According to an aspect of the present invention a transceiver for a local lighting system comprising a bus and a control unit electrically connected to the bus for controlling communication via the bus is provided. The transceiver comprises a transmitter, preferably an infrared transmitter, configured to transmit wireless signals to a global lighting system comprising one or more luminaires; a receiver, preferably an infrared receiver, configured to receive wireless signals from the global lighting system; and a processing unit configured to process the received wireless signals from the global lighting system. The transceiver is configured to be electrically connected to the bus of the local lighting system. The processing unit of the transceiver is configured to convert the received wireless signals into bus signals such that the transceiver behaves as an input device of the local lighting system when electrically connected to the bus.

In other words, an aspect of the present invention proposes a transceiver configured to wirelessly communicate with a global lighting system, wherein the transceiver is configured to emulate an input device of the local lighting system by converting received wireless signals from the global lighting system into bus signals of the local lighting system. The bus signals may be transmitted via the bus to the control unit of the local lighting system. That is, the transceiver may be configured to transmit the bus signals via the bus to the control unit of the local lighting system.

In particular, the control unit is configured to control light emission of the local lighting system. That is, the control unit may be configured to control via the bus the local lighting system. The control unit may be configured to control light emission of the local lighting system on the basis of bus signals that are transmitted by the transceiver via the bus of the local lighting system. The control unit is a central controller of the local lighting system, in particular for controlling the function of the local lighting system comprising controlling the light emission of the local lighting system. The control unit may be a module that is electrically connected to the bus.

The terms "in particular", "preferably" and "optionally" are used as synonyms for introducing optional features.

That is, from the perspective of the control unit of the local lighting system there is no difference between the transceiver according to an aspect of the present invention, when electrically connected to the bus, and an actual input device of the local lighting system that may be electrically connected or that is electrically connected to the bus. Namely, as already outlined above the transceiver is configured to behave as an input device of the local lighting system respectively is configured to emulate such an input device when the transceiver is electrically connected to the bus.

Therefore, the transceiver allows the local lighting system to be incorporated into the global lighting system and in particular to participate in the global lighting system as a member without the need of adapting the local lighting system to the global lighting system. In particular without the need of adapting the communication via the bus of the local lighting system to the wireless communication of the global lighting system.

Namely, the transceiver is configured to receive wireless signals from the global lighting system and to convert the received wireless signals into bus signals of the local lighting system, such that there is no difference for the control unit of the local lighting system between an actual input device of the local lighting system and the transceiver when electrically connected to the bus. That is, for incorporating the local lighting system into the global lighting system, a user only needs to electrically connect the transceiver to the bus of the local lighting system. No adaption of the local lighting system, in particular no adaption of the communication via the bus of the local lighting system is required.

Since the transceiver is configured to behave as an input device of the local lighting system when electrically connected to the bus, the transceiver may be referred to as a virtual input device respectively artificial input device of the local lighting system.

The local lighting system is preferably a luminaire. Alternatively, the local lighting system may also be a lighting of a building.

Preferably, the bus of the local lighting system is a DALI-2 bus and the control unit of the local lighting system is a DALI-2 application controller. That is, the local lighting system is preferably based on the DALI-2 industry standard, in particular the industry standard according to "IEC 62386 Edition 2" of the International Electrotechnical Commission, and, thus, the components of the local lighting system, such as the bus and the control unit, are also based on the DALI-2 industry standard respectively are DALI-2 components or DALI-2 compatible components.

In case the local lighting system is based on the DALI-2 industry standard, the processing unit of the transceiver is configured to convert the received wireless signals into DALI-2 signals respectively DALI-2 bus signals such that the transceiver behaves as a DALI-2 input device of the local lighting system when electrically connected to the bus.

Therefore, as already mentioned above, according to an aspect of the present disclosure a transceiver for a local lighting system, preferably for a luminaire, comprising a bus, preferably a DALI-2 bus, and a control unit, preferably a DALI-2 application controller, electrically connected to the bus for controlling communication via the bus, is provided. The transceiver comprises a transmitter, preferably an infrared transmitter, configured to transmit wireless signals to a global lighting system comprising one or more luminaires; a receiver, preferably an infrared receiver, configured to receive wireless signals from the global lighting system; and a processing unit configured to process the received wireless signals from the global lighting system. The transceiver is configured to be electrically connected to the bus of the local lighting system. The processing unit of the transceiver is configured to convert the received wireless signals into bus signals, preferably DALI-2 signals, such that the transceiver behaves as an input device, preferably as a DALI-2 input device, of the local lighting system when electrically connected to the bus.

The local lighting system may be a part of the global lighting system, wherein the transceiver allows wireless communication with other members of the global lighting system.

The term "DALI-2" refers to an industry standard according to "IEC 62386 Edition 2" of the International Electrotechnical Commission, which is the follow-up standard of the industry standard called DALI ("Digital Addressable Lighting Interface") respectively DALI, Edition 1, wherein DALI and DALI-2 are known industry standards in the technical field of lighting. The term "DALI-2" stands for "Digital Addressable Lighting Interface, Edition 2.

Preferably, the transceiver is configured to be detachably connected to the bus of the local lighting system. That is, the transceiver may be electrically connected as a separate module to the bus of the local lighting system, when a user wants to incorporate the local lighting system into the global lighting system and may also be detached again from the local lighting system. In other words, the transceiver is configured to be modularly connected to the local lighting system, in particular to the bus of the local lighting system. Therefore, the transceiver may be a module (also referred to as transceiver module) that is configured to be detachably connected to the bus of the local lighting system. Thus, in case the local lighting system is a luminaire, the transceiver may be a module for the luminaire that is configured to be detachably connected to the bus of the luminaire. Therefore, the local lighting system, e.g. being a luminaire, may be upgraded for a wireless communication with a global lighting system comprising one or more luminaires by detachably connecting the transceiver to the bus of the local lighting system.

When the transceiver is connected to the bus of the local lighting system, this lets the initial functionality, which preferably may comprise wireless communication, of the control unit of the local lighting system unaffected.

Since the transceiver is configured to be electrically connected, preferably detachably, to the bus of the local lighting system, the transceiver is not a part of the control unit of the local lighting system. In contrast, the transceiver is a separate module that may be connected besides the control unit and other optional electrical components of the local lighting system to the bus of the local lighting system. That is, the transceiver may be configured to be electrically connected to the bus (in particular as a separate module) in addition to the control unit already electrically connected to the bus. Thus, the transceiver is not a part of the control unit representing a central controller of the local lighting system and does not represent a central controller of the local lighting system, when the transceiver is electrically connected to the bus.

The transceiver may be configured to be electrically supplied, in particularly separately to the control unit, with electrical energy via the bus of the local lighting system when the transceiver is connected to the bus. Alternatively or additionally, the transceiver may be configured to be electrically supplied with electrical energy via an own electrical energy source, such as a battery that is preferably rechargeable. Alternatively or additionally, the transceiver may be configured to be electrically supplied with electrical energy via an own power supply terminal, in particular in form of a mains adapter.

The transmitter of the transceiver is configured for a wireless communication with the global lighting system. The transmitter is configured to transmit/send wireless signals to the global lighting system. That is, the transmitter is configured to wirelessly transmit/send messages to the global lighting system.

Preferably, the transmitter is an infrared transmitter. The transmitter is not limited to an infrared transmitter. Additionally or alternatively, the transmitter may comprise or correspond to a visible light transmitter, a radio transmitter, a ultrasonic transmitter, an infrasound transmitter and/or any other known transmitter. According to an embodiment, the transmitter is a short range transmission transmitter, i.e. a transmitter configured to transmit wireless signals in the form of a short range transmission. Examples of a short range transmission (may be referred to as short range communication) comprise infrared transmission, visible light transmission, ultrasound transmission and infrasound transmission. In case the transmitter is a radio transmitter, it may be configured to transmit the wireless signals according to the Bluetooth industry standard, the WLAN industry standard and/or any other known industry standard for radio communication.

The receiver of the transceiver is configured for a wireless communication with the global lighting system. The receiver is configured to receive wireless signals from the global lighting system. That is, the receiver is configured to wirelessly receive messages from the global lighting system.

Preferably, the receiver is an infrared receiver. The receiver is not limited to an infrared receiver. Additionally or alternatively, the receiver may comprise or correspond to a visible light receiver, a radio receiver, an ultrasonic receiver, an infrasound receiver and/or any other known receiver. According to an embodiment, the receiver is a short range transmission receiver, i.e. a receiver configured to receive wireless signals that are transmitted in the form of a short range transmission. In case the receiver is a radio receiver, it may be configured to receive wireless signals according to the Bluetooth industry standard, the WLAN industry standard and/or any other known industry standard for radio communication.

According to an embodiment, the transceiver may be configured for a visible light communication, infrared communication, ultrasound communication and/or infrasound communication with the global lighting system. The transmitter of the transceiver may be configured to transmit wireless signals in the form of visible light, infrared, ultrasound and/or infrasound. The receiver of the transceiver may be configured to receive wireless signals in the form of visible light, infrared, ultrasound and/or infrasound.

This may be advantageous when the transceiver takes part in a wireless swarm communication based on visible light, infrared, ultrasound and/or infrasound of the global lighting system due to the limited transmission range of visible light, infrared, ultrasound and/or infrasound, as outlined further below.

The transceiver is preferably configured to wirelessly communicate with the global lighting system according to a swarm protocol, in particular an adaptive swarm protocol. That is, the transceiver may be configured to take part in a wireless swarm communication (i.e. wireless communication according to a swarm protocol) of the global lighting system. The wireless swarm communication may be based on visible light, infrared, ultrasound and/or infrasound.

The processing unit preferably corresponds to or comprises a processor, microprocessor, controller, microcontroller, application-specific integrated circuit (ASIC) or any combination of these elements.

Moreover, the processing unit is preferably configured to understand at least some bus commands of the local lighting system such as commands for addressing and configuration. That is the processing unit is preferably configured to interpret respectively evaluate at least some bus commands and, thus, to react thereto accordingly. For example, the processing unit is configured to be assigned an address via the bus and/or to be configured in a configuration process via the bus, when the transceiver is electrically connected to the bus, in particular at the time when the transceiver is electrically connected to the bus.

The processing unit may be configured to communicate via the bus of the local lighting system when electrically connected to the bus. In particular, the processing unit is configured to communicate bus signals via the bus of the local lighting system such that the transceiver behaves as an input device of the local lighting system. In other words, the processing unit may be configured to communicate via the bus of the local lighting system such that, from the perspective of the control unit or any other electric component of the local lighting system connected to the bus, there is no difference between the bus communication by the transceiver and a bus communication by an actual input device of the local lighting system that may be electrically connected or that is electrically connected to the bus.

Preferably, the processing unit of the transceiver is configured to communicate messages via the bus in the form of bus signals that may be communicated by an (actual) input device of the local lighting system. As a result thereof, the transceiver behaves as an input device of the local lighting system, when communicating messages via the bus. Bus signals that may be communicated by an input device may also be referred to as bus signals communicable by an input device or as bus signals of an input device (i.e. these passages are to be understood as synonyms).

The processing unit may be configured to communicate messages via the bus to the control unit in the form of bus signals of an (actual) input device of the local lighting system. When receiving a wireless signal from the global lighting system, the processing unit may be configured to communicate a message, such as a push message, via the bus in the form of one or more bus signals of an (actual) input device of the local lighting system. Said message (push-message) may comprise an indication of the received wireless signal and/or information comprised by the received wireless signal. Thus, when receiving a wireless signal from the global lighting system, the processing unit may be configured to communicate the aforementioned message via the bus to the control unit of the local lighting system. In other words, the transceiver, in particular the processor unit, may be configured to transmit messages via the bus without the control unit requesting the messages from the transceiver in advance. That is, the transceiver, in particular the processor unit, may be configured to communicate on own initiative via the bus of the local lighting system.

In case the local lighting system is based on the DALI-2 industry standard (DALI-2 lighting system) the processing unit is preferably configured to understand at least some DALI-2 commands respectively DALI-2 bus commands, such as commands for addressing and configuration. The processing unit may be configured to communicate via the DALI-2 bus of the local lighting system when electrically connected to the DALI-2 bus. In particular, the processing unit is configured to communicate DALI-2 signals via the DALI-2 bus such that the transceiver behaves as a DALI-2 input device. In other words, the processing unit may be configured to communicate via the DALI-2 bus of the local lighting system such that, from the perspective of the DALI-2 application controller or any other electric component of the local lighting system connected to the DALI-2 bus, there is no difference between the bus communication by the transceiver and a bus communication by an actual DALI-2 input device of the local lighting system that may be electrically connected or that is electrically connected to the DALI-2 bus.

Moreover, in case the local lighting system is based on the DALI-2 industry standard (DALI-2 lighting system), the processing unit of the transceiver may be configured to communicate messages via the DALI-2 bus in the form of DALI-2 signals of an (actual) DALI-2 input device. Therefore, the processing unit may be configured to communicate messages via the DALI-2 bus to the DALI-2 application controller in the form of DALI-2 signals of an (actual) DALI-2 input device. When receiving a wireless signal from the global lighting system, the processing unit may be configured to communicate a message, such as a push message, via the DALI-2 bus in the form of one or more DALI-2 signals of an (actual) DALI-2 input device of the local lighting system. Said message (push-message) may comprise an indication of the received wireless signal and/or information comprised by the received wireless signal. Thus, when receiving wireless signals from the global lighting system, the processing unit may be configured to communicate the aforementioned message via the DALI-2 bus to the DALI-2 application controller of the local lighting system.

Bus signals may be bus commands, such as control commands, or data, such as data measured by a sensor (sensor data). Preferably, the input device of the local lighting system is an occupancy sensor or a user interface. In particular, the input device is a presence and/or movement sensor or a push-button device comprising at least one push-button. The user interface may comprise or correspond to at least one push-button, electro-mechanical switch, on/off switch, dimmer switch, multi-position switch, digital input, analog input, slider control element, rotary control element and/or touch display.

That is, the processing unit of the transceiver is preferably configured to convert the received wireless signals into bus signals such that the transceiver behaves as an occupancy sensor, in particular as a presence and/or movement sensor, of the local lighting system when electrically connected to the bus. Alternatively, the processing unit of the transceiver is configured to convert the received wireless signals into bus signals such that the transceiver behaves as a user interface, in particular as a push-button device comprising at least one push-button or any other user interface mentioned herein, of the local lighting system when electrically connected to the bus.

Preferably, the processing unit of the transceiver is configured to convert a received wireless signal into a bus signal, such that the transceiver behaves as a user interface comprising a plurality of elements and the bus signal is indicative of at least one element of the user interface. The plurality of elements may correspond to at least one push-button, electro-mechanical switch, on/off switch, dimmer switch, multi-position switch, digital input, analog input, slider control element, rotary control element and/or element of a touch display. That is, information from a wireless signal could be coded in a bus signal by reporting the elements of the user interface evaluated by the transceiver as different elements. In particular, the processing unit of the transceiver is configured to convert the received wireless signals into bus signals, such that the transceiver behaves as a push-button device comprising a plurality of push-buttons and the bus signal is indicative of at least one push-button of them. That is, information from a wireless signal could be coded in a bus signal by reporting the push-buttons of the push-button device evaluated by the transceiver as different push-buttons.

In case the local lighting system is based on the DALI-2 industry standard, the input device is preferably an occupancy sensor according to DALI-2, in particular DALI-2 Part 303, more preferably a presence and/or movement sensor according to DALI-2, in particular DALI-2 Part 303. Alternatively, in case the local lighting system is based on the DALI-2 industry standard, the input device is preferably a user interface according to DALI-2, in particular DALI-2 Part 301 and/or Part 302, more preferably a push-button device comprising at least one push-button according to DALI-2, in particular DALI-2 Part 301.

That is, in case the local lighting system is based on the DALI-2 industry standard, the processing unit of the transceiver is preferably configured to convert the received wireless signals into DALI-2 bus signals such that the transceiver behaves as a DALI-2 occupancy sensor or as a DALI-2 user interface, when the transceiver is electrically connected to the bus (DALI-2 bus). In particular, in case the local lighting system is based on the DALI-2 industry standard, the processing unit of the transceiver is configured to convert the received wireless signals into DALI-2 bus signals such that the transceiver behaves as a DALI-2 presence and/or movement sensor or as a DALI-2 push-button device with at least one push-button, when the transceiver is electrically connected to the bus (DALI-2 bus).

Preferably, the case and/or interface of the transceiver is according to the Zhaga industry standard, in particular according to Zhaga Book 18 or Zhaga Book 20. The Zhaga Book 18 of the Zhaga industry standard covers outdoor luminaires and the Zhaga Book 20 of the Zhaga industry standard covers indoor luminaires.

In particular, the processing unit of the transceiver is configured to convert a received wireless signal into a bus signal, such that the transceiver behaves as an input device of the local lighting system and the bus signal is indicative of an event known by the control unit of the local lighting system. Such an event could be "detection by a sensor", such as detection of a user detected by an occupancy sensor or "actuating (e.g. pressing) of a user interface", such as pressing of at least one push-button or actuating any other user interface element mentioned herein. In this case, the transceiver is preferably a receiver for a DALI-2 lighting system, such as a DALI-2 luminaire.

That is, in case the received wireless signal causes the transceiver to behave as an occupancy sensor, the processing unit of the transceiver is preferably configured to convert the received wireless signal to a bus signal that is indicative of an event of the sensor, for example "detection of a user by the occupancy sensor". Moreover, in case the received wireless signal causes the transceiver to behave as a push-button device, the processing unit of the transceiver is preferably configured to convert the received wireless signal to a bus signal that is indicative of an event of the push-button device, for example, "pressing one push-button" of the push-button device.

Preferably, the processing unit is configured to convert a wireless signal received by the receiver into a bus signal on the basis of at least one parameter of the wireless signal such that the transceiver behaves as an input device out of a group of input devices depending on the at least one parameter.

That is, the transceiver is configured to emulate an input device out of a group of possible input devices of the local lighting system depending on the at least one parameter of the received wireless signal. The local lighting system may have a known group of possible input devices that are configured to be electrically connected to the bus and the transceiver is configured to behave as one input device out of the known group of input devices depending on the at least one parameter of the received wireless signal.

The processing unit may be configured to communicate a message via the bus in the form of one or more bus signals (that may be communicated by an (actual) input device of the local lighting system), wherein the message comprises, depending on the at least one parameter, a characteristic value (may also be referred to as identifier or instance) out of a group of characteristic values of a bus protocol of the local lighting system. The bus protocol is used at the local lighting system for the bus communication via the bus. In case the local lighting system is based on the DALI-2 industry standard (DALI-2 lighting system), the characteristic values may correspond to instances defined by DALI-2 (DALI-2 instances).

Therefore, in response to receiving the wireless signal comprising the at least one parameter, the processing unit is configured to communicate a message, such as a push message, comprising the characteristic value out of the group of characteristic values via the bus to the control unit.

Preferably, the transceiver, in particular the processing unit, is configured to receive via the bus information indicative of the group of input devices and/or the group of characteristic values of the bus protocol of the local lighting system, when the transceiver is electrically connected to the bus. That is, the transceiver, in particular the processing unit, is configured to learn about the group of possible input devices of the local lighting system and/or the group of characteristic values of the bus protocol of the local lighting system from information received via the bus when connected to the bus. This may be done during a configuration process, preferably automatically triggered at the time when a user electrically connects the transceiver to the bus of the local lighting system.

Additionally or alternatively, information about/indicative of the local lighting system, in particular of the group of possible input devices and/or the group of characteristic values of the bus protocol of the local lighting system, may be already stored in the transceiver before connecting the transceiver to the local lighting system, for example by a user. Additionally or alternatively, such information may be communicated to the transceiver from extern, for example by a user.

Further, the at least one parameter is preferably indicative of the distance from the transceiver to the original luminaire of the global lighting system that originally transmitted the wireless signal.

In such a case, the transceiver is preferably configured to behave as an input device out of a group of input devices that corresponds to the distance from the transceiver to the original luminaire of the global lighting system that originally transmitted the wireless signals. Preferably, each input device of the group of input devices is linked to a distance or distance range and the processing unit is configured to choose on the basis of the at least one parameter of the received wireless signal which input device of the group of input devices the transceiver is to behave as respectively is to emulate in response to the respective received wireless signal.

Each characteristic value of the group of characteristic values may be linked to a distance or distance range measured from the local lighting system, in particular from the control unit, the light source of the local lighting system or the transceiver when connected to the bus. That is, the distance of a position to the local lighting system, in particular to the control unit or the light source of the local lighting system, may be partitioned in distance steps, wherein the characteristic values may correspond to the distance steps. That is, when the local lighting system is a luminaire, each characteristic value of the group of characteristic values may be linked to a distance or distance range measured from the luminaire, in particular from the control unit, the light source of the luminaire or the transceiver when connected to the bus.

In response to receiving the wireless signal comprising the at least one parameter, the processing unit may be configured to choose, on the basis of the at least one parameter, the characteristic value out of the group of characteristic values that is linked to the distance or distance range corresponding to the distance indicated by the at least one parameter (i.e. the distance from the transceiver to the original luminaire of the global lighting system that originally transmitted the wireless signal). The processing unit may be configured to communicate a message comprising said chosen characteristic value via the bus to the control unit in the form of one or more bus signals. As a result, the transceiver may behave as an input device that corresponds to the distance from the transceiver to the original luminaire of the global lighting system that originally transmitted the wireless signal. The characteristic values may correspond to the input devices of the group of input devices, wherein each input device of the group of input devices is linked to a distance or distance range. By communicating a message comprising the chosen characteristic value to the control unit of the local lighting system, the processing unit is able to inform the control unit about the distance, preferably in terms of distance steps, between the transceiver and the original luminaire of the global lighting system.

Alternatively or additionally, the processing unit may be configured to determine respectively measure on the basis of a received wireless signal the distance between the luminaire of the global lighting system, from which the transceiver received the wireless signal. Said distance determination/measurement by the processing unit on the basis of the received wireless signal may be performed by the processing unit using the relation between one or more characteristics of the received wireless signal, such as signal strength, incidence angle, run-time difference etc., and the distance to the source of the received wireless signal. That is, the processing unit may use a linkage between different values of the one or more characteristics and corresponding distances.

The processing unit may be configured to determine the distance, as outlined above, when the global lighting system corresponds to the lighting of a predetermined area, such as a room, in which the local lighting system is also present and the transmission range of the wireless communication, i.e. wireless signals, of the global lighting system is limited to said predetermined area. This may be the case, when the wireless communication is based on visible light, infrared, ultrasound and/or infrasound. Namely, wireless signals in the form of visible light, infrared, ultrasound and/or infrasound comprise a limited transmission range and are shielded by walls of a room. In the aforementioned case, wireless signals received by the transceiver may correspond to wireless signals received from the original luminaire of the global lighting system that originally transmitted the wireless signals and not to wireless signals received from a luminaire of the global lighting system that retransmitted/relayed the wireless signals. That is, the luminaires of the global lighting system may be configured to not retransmit/relay wireless signals. The terms "retransmit", "forward" and "relay" ma be used as synonyms. The processing unit may be configured to choose, on the basis of the determined distance, the characteristic value out of the group of characteristic values that is linked to the distance or distance range corresponding to the determined distance.

Therefore, the different characteristic values out of the group of characteristic values may be used by the transceiver (when receiving wireless signals from the global lighting system) for informing the control unit about the distance, in particular in terms of distance steps, between the transceiver and the original luminaire of the global lighting system that originally transmitted the wireless signals. The different characteristic values may be used by the transceiver for emulating/behaving as an input device of the local lighting system that corresponds to the distance between the transceiver and the original luminaire of the global lighting system that originally transmitted the wireless signals.

The transceiver, in particular the processing unit, is configured to store the linkage between the input devices and the respective linked distance or distance range and/or the linkage between the characteristic values and the respective linked distance or distance range in a storage unit, in particular in a look-up table, from which it can also read the stored data. Preferably, the processing unit of the transceiver is configured to receive that linkage information via the bus of the local lighting system when the transceiver is electrically connected to the bus. In particular, the processing unit is configured to receive that linkage information during configuration of the transceiver via the bus of the local lighting system.

Additionally or alternatively, that linkage information may be already stored in the storage before connecting the transceiver to the local lighting system, for example by a user. Additionally or alternatively, that linkage information may be communicated to the transceiver from extern, for example by a user.

Furthermore, the at least one parameter is preferably a count corresponding to the number of luminaires of the global lighting system via which the wireless signal is transmitted from the original luminaire to the transceiver.

The original luminaire may also be referred to as primary luminaire, as it is the first luminaire to transmit the wireless signal.

Moreover, each input device of the group of input devices is preferably configured to transmit bus signals that identify the respective input device as the transmitter of the bus signals.

That is, the processing unit of the transceiver is preferably configured to convert a wireless signal received by the receiver into a bus signal on the basis of at least one parameter of the wireless signal in order to behave as the input device corresponding to/linked with the at least one parameter out of the group of input devices, such that the bus signal identifies the input device corresponding to the at least one parameter.

Preferably, the receiver is configured to receive a wireless signal transmitted from the global lighting system, the wireless signal comprising a count corresponding to the number of luminaires of the global lighting system via which the wireless signal is transmitted from the original luminaire to the transceiver. The processing unit may be configured to determine, on the basis of the count, the distance from the transceiver to the original luminaire of the global lighting system that originally transmitted the wireless signal. The above description with respect to at least one parameter indicative of a distance and the above description with respect to determining a distance may be correspondingly valid for the distance determination based on the count comprised by the wireless signal.

According to an embodiment, the receiver is configured to receive a wireless signal transmitted in the form of a short range transmission from the global lighting system, the wireless signal comprising a count corresponding to the number of luminaires of the global lighting system via which the wireless signal is transmitted from the original luminaire to the transceiver. The processing unit may be configured to determine, on the basis of the count, the distance from the transceiver to the original luminaire of the global lighting system that originally transmitted the wireless signal in the form of a short range transmission. With other words, the wireless communication of the global lighting system may be based on short range transmission (may be referred to as short range communication). As mentioned already above, examples of a short range transmission comprise infrared transmission, visible light transmission, ultrasound transmission and infrasound transmission.

Preferably the group of input devices is a group of occupancy sensors and/or user interfaces. In particular the group of input devices is a group of presence and/or movement sensors and/or push-button devices each comprising at least one push-button. The user interfaces may correspond to user interfaces mentioned herein.

That is, the processing unit is preferably configured to convert a wireless signal received by the receiver into a bus signal on the basis of at least one parameter of the wireless signal such that the transceiver behaves as an occupancy sensor or as a user interface out of a group of occupancy sensors and/or user interfaces depending on the at least one parameter. More preferably, the processing unit is configured to convert a wireless signal received by the receiver into a bus signal on the basis of at least one parameter of the wireless signal such that the transceiver behaves as a presence and/or movement sensor or as a push-button device comprising at least one push-button out of a group of presence and/or movement sensors and/or push-button devices each comprising at least one push-button, depending on the at least one parameter.

In case the local lighting system is based on the DALI-2 industry standard, the input devices are DALI-2 input devices; preferably DALI-2 occupancy sensors, in particular occupancy sensors according to DALI-2 Part 303, more preferably DALI-2 presence and/or movement sensors, in particular presence and/or movement sensors according to DALI-2 Part 303. Alternatively or additionally, the input devices are preferably DALI-2 user interfaces, in particular user interfaces according to DALI-2 Part 301 and/or Part 302, more preferably DALI-2 push-button devices each comprising at least one push-button, in particular push-button devices each comprising at least one push-button according to DALI-2 Part 301.

In addition or alternatively, in case an input device comprises a group of elements, such as a push-button device comprising a group of push-buttons (a plurality of push-buttons), the processing unit of the transceiver is preferably configured to convert a wireless signal received by the receiver into a bus signal on the basis of the at least one parameter of the wireless signal such that the transceiver behaves as an element of the plurality of elements of the input devices. For example, the processing unit of the transceiver may be configured to convert a wireless signal received by the receiver into a bus signal on the basis of the at least parameter of the wireless signal such that the transceiver behaves as a push-button out of the group of push-buttons of a push-button device.

The above description with respect to a group of input devices is for the group of elements of an input device correspondingly valid.

That is, in case the at least one parameter is preferably indicative of the distance from the transceiver to the original luminaire of the global lighting system that originally transmitted the wireless signal, the transceiver is preferably configured to behave as an element (e.g. push-button) out of a group of elements of an input device (group of push-buttons of a push-button device) that corresponds to (is associated with) the distance from the transceiver to the original luminaire of the global lighting system that originally transmitted the wireless signal.

Preferably, each element (push-button) of the group of elements of the input device (group of push-buttons of a push-button device) is linked to a distance or distance range and the processing unit chooses on the basis of the at least one parameter of the received wireless signal which element (push-button) of the group of elements of the input device (group of push-buttons of the push-button device) the transceiver is to behave as respectively is to emulate in response to the respective received wireless signal.

The transceiver, in particular the processing unit, is configured to store the linkage between the elements of the input device (push-buttons of the push-button device) and the respective linked distance or distance range in a storage unit, in particular in a look-up table, from which it can also read the stored data. Preferably, the processing unit of the transceiver is configured to receive that linkage information via the bus of the local lighting system when the transceiver is electrically connected to the bus. In particular, the processing unit is configured to receive that linkage information during configuration of the transceiver via the bus of the local lighting system.

Additionally or alternatively, that linkage information may be already stored in the storage before connecting the transceiver to the local lighting system, for example by a user. Additionally or alternatively, that linkage information may be communicated to the transceiver from extern, for example by a user.

Preferably, the processing unit of the transceiver is configured to monitor the bus of the local lighting system when the transceiver is electrically connected to the bus and to control on the basis of a bus signal, transmitted in the local lighting system via the bus, the transmitter to transmit a wireless signal indicative of the bus signal to the global lighting system.

This has the advantage, that information such as control commands or data transmitted via the bus in the local lighting system can be provided to the global lighting system. As a result, not only the local lighting system may be controlled based on information provided from the global lighting system but also the global lighting system may be controlled based on information provided from the local lighting system.

The transceiver may be configured to read from the bus signals communicated via the bus when the transceiver is electrically connected to the bus. Thus, the transceiver may be configured to read from the bus a bus signal communicated by an input device (such as an occupancy sensor, any other sensor or a user interface) via the bus to the control unit of the local lighting system and to use the information of said read bus signal for controlling the global lighting system, in particular luminaires of the global lighting system, by transmitting one or more respective wireless signals to the global lighting system. That is, the transceiver may be configured to directly use bus signals communicated via the bus from input devices of the local lighting system (without communicating via the bus with the control unit in advance).

In a swarm operation of the global lighting system (i.e. the luminaires of the global lighting system wirelessly communicate with each other according to a swarm protocol), a luminaire (may be referred to as original luminaire) of the global lighting system, emitting light in response to a command by a user via a user interface of the luminaire or an occupancy sensor of the luminaire detecting a person, may inform about said event other luminaires of the global lighting system by transmitting one or more wireless signals indicative of the light emission, the user command and/or the detection of the person. As a result, luminaires receiving said wireless signals may also start light emission and/or retransmit the wireless signals. Whether a luminaire starts light emission in response to receiving the wireless signals originally transmitted from the original luminaire may depend on the distance between the respective luminaire and the original luminaire. According to an embodiment, it may depend on the number of luminaires that have retransmitted the wireless signals received by the luminaire, because this number may be an indicator of the distance between the luminaire and the original luminaire. Whether a luminaire retransmits received wireless signals may depend on the distance between the respective luminaire and the original luminaire, in particular on the number of luminaires that have retransmitted the wireless signals received by the luminaire. The above described swarm operation may be referred to as "adaptive swarm operation", because the luminaires of the global lighting system may be configured to retransmit wireless signals and, thus, no configuration of the luminaires is required for controlling the light emission of the luminaires in dependence of the retransmitted wireless signals.

For the local lighting system to participate in a swarm operation, in particular an adaptive swarm operation, of the global lighting system, the transceiver may be configured to detect whether an input device of the local lighting system communicates via the bus an event that causes the local lighting system to emit light, such as an occupancy sensor of the local lighting system detecting presence and/or movement of a person or a user interface of the local lighting system being actuated by a user for initiating light emission by the local lighting system, by reading from the bus signals transmitted from input devices via the bus to the control unit. In response to such a detection the transceiver may be configured to transmit wireless signals to the global lighting system informing about the event causing a light emission by the local lighting system. Therefore, the transceiver may allow the local lighting system to act as an original luminaire of a wireless swarm communication of the global lighting system.

The function of an occupancy sensor of the local lighting system may be integrated in the transceiver and, thus, the transceiver may be configured to transmit wireless signals to the global lighting system informing about a person's presence and/or movement detection causing light emission by the local lighting system, without the need of reading bus signals communicated via the bus of the local lighting system.

In the light of the above, the transceiver may adapt the local lighting system for a swarm operation of the global lighting system without the need of configuring the local lighting system, in particular the communication via the bus, by programming the control unit. As a result, the light emission of neighboring luminaires of the global lighting system may be controlled on the basis of events causing a light emission by the local lighting system, which are communicated by input devices via the bus to the control unit of the local lighting system. Said events may be wirelessly communicated according to a swarm protocol by the transceiver to the global lighting system, when the transceiver is connected to the bus of the local lighting system. Such a swarm operation is advantageous, because it allows to control neighboring luminaires of the global lighting system to be automatically controlled dependent on events (such as an occupancy sensor of the local lighting system detecting presence and/or motion of a person) that cause a light emission by the local lighting system. Thus, for the control of the luminaires of the global lighting system, a configuration of neither the luminaires of the global lighting system (e.g. by setting fixed groups of luminaires) nor of the communication via the bus of the local lighting system is necessary.

The transceiver may be configured to retransmit/relay wireless signals received from the global lighting system. When retransmitting a wireless signal, the transceiver may increment (increase) a count in case the received wireless signal comprises the count as at least one parameter indicative of the distance between the transceiver and the original luminaire of the global lighting system that originally transmitted the wireless signal.

The processing unit of the transceiver is preferably configured to filter received wireless signals according to at least one criterion, such as a priority assigned to the wireless signals, and retransmit/relay only wireless signals fulfilling the at least one criterion. The priority of a wireless signal may correspond, for example, to the distance between the transceiver and the original luminaire of the global lighting system that originally transmitted the wireless signal. Thus, wireless signals that are received from a luminaire, which is too far away, may have a corresponding priority that does not fulfill the priority requirement and, thus, the processing unit of the transceiver would not retransmit such wireless signals.

In particular the transceiver is configured to transmit a wireless signal indicative of a bus signal transmitted via the bus of the local lighting system to the global lighting system independent of any process performed by the local lighting system, in particular the control unit, in response to the bus signal.

Further, the processing unit of the transceiver is preferably configured to filter the received wireless signals according to at least one criterion, such as a priority assigned to the wireless signals, and to convert only wireless signals fulfilling the at least one criterion into bus signals. The priority of a wireless signal may correspond, for example, to the distance between the transceiver and the original luminaire of the global lighting system that originally transmitted the wireless signal. Thus, wireless signals that are received from a luminaire, which is too far away, may have a corresponding priority that does not fulfill the priority requirement and, thus, the processing unit of the transceiver would not convert such wireless signals.

In the light of the above, the transceiver may be configured for at least the following functions:

- transmitting one or more wireless signals to the global lighting system in case the transceiver detects on the bus an event causing a light emission by the local lighting system (such as a detection of a person by an occupancy sensor of the local lighting system or a user inputting a light turn on command via a user interface of the local lighting system), the event being communicated by an input device (e.g. occupancy sensor or user interface) of the local lighting system via the bus, wherein the one or more wireless signals may be indicative of said event;
- retransmitting/relaying a wireless signal received from the global lighting system to the global lighting system and optionally, in case the wireless signal comprises a count, incrementing the count before retransmitting the wireless signal; and/or
- communicating a message, such as a push message, via the bus to the control unit of the local lighting system in the form of one or more bus signals of an (actual) input device of the local lighting system in response to receiving a wireless signal from the global lighting system, wherein the message (push-message) may comprise an indication of the received wireless signal and/or information comprised by the received wireless signal.

In order to achieve the transceiver according to an aspect of the present invention, some or all of the above described optional features may be combined with each other.

According to a further aspect of the present invention, a luminaire is provided. The luminaire comprises a bus, a control unit electrically connected to the bus and configured to control communication via the bus, and a transceiver according to an aspect of the present invention, as described above, electrically connected to the bus.

The above description with regard to the transceiver according to an aspect of the present invention is also valid for the transceiver of the luminaire according to a further aspect of the present invention.

Preferably, the bus of the luminaire is a DALI-2 bus and the control unit of the luminaire is a DALI-2 application controller. That is, the luminaire is preferably based on the DALI-2 industry standard, in particular the industry standard according to "IEC 62386 Edition 2" of the International Electrotechnical Commission and, thus, the components of the luminaire, such as the bus and the control unit, are also based on the DALI-2 industry standard respectively are DALI-2 components.

Therefore, as already mentioned above, according to a further aspect of the present disclosure a luminaire is provided. The luminaire comprises a bus, in particular a DALI-2 bus, a control unit, in particular a DALI-2 application controller, electrically connected to the bus and configured to control communication via the bus, and a transceiver according to an aspect of the present invention, as described above, wherein the transceiver is electrically connected to the bus.

The luminaire may be referred to as a local lighting system. That is, the components of the luminaire, such as the ones electrically connected to the bus, form a local lighting system.

The control unit preferably comprises or corresponds to a processor, microprocessor, controller, microcontroller, application-specific integrated circuit (ASIC) or any combination of these elements.

The control unit represents a central controller of the luminaire, in particular for controlling the function of the luminaire comprising controlling the light emission of the luminaire. That is, the control unit may be configured to control via the bus the luminaire. Since the transceiver is connected, preferably detachably, to the bus of the luminaire, the transceiver is not a part of the control unit. In contrast, the transceiver is a separate module that is connected besides the control unit and other (optional) electrical components of the luminaire to the bus of the luminaire. That is, the transceiver is connected in addition to the control unit to the bus of the luminaire. Thus, the transceiver is not a part of a central controller of the luminaire and does not represent a central controller of the luminaire. The control unit may be a module that is electrically connected to the bus. That is the transceiver and the control unit are preferably separate modules of the luminaire that are electrically connected to the bus of the luminaire.

Further, the control unit is preferably configured to communicate, in particular transmit and/or receive, information such as commands or data from extern respectively from outside the luminaire. This communication is preferably a wireless communication, in particular according to the Bluetooth industry standard, the WLAN industry standard or any other known industry standard for wireless communication. Therefore, it is possible, for example, that a user inputs via an app on his mobile electronic end device, e.g., mobile phone, a desired dim level for setting the light intensity of the light emitted by the luminaire to the control unit of the luminaire, wherein the desired dim level is wirelessly transmitted from the mobile electronic end device to the control unit according to, e.g., the Bluetooth industry standard. In other words, the control unit preferably comprises a communication interface for communicating with the outside of the luminaire, in particular with external devices. The communication interface may be a wireless communication interface for wirelessly communicating with the outside of the luminaire, in particular with external devices Furthermore, the control unit is preferably configured to receive bus signals via the bus from the transceiver behaving as an input device of the luminaire.

Preferably, the control unit is configured to assign an address and/or configure the transceiver in a configuration process when the transceiver is electrically connected to the bus of luminaire, in particular at the time when the transceiver is electrically connected to the bus of the luminaire.

Furthermore, the transceiver is preferably detachably connected to the luminaire, in particular to the bus of the luminaire.

Preferably, the luminaire further comprises at least one lighting means driver for driving at least one lighting means, preferably at least one LED driver for driving at least one LED; wherein the control unit is configured to receive bus signals via the bus from the transceiver behaving as an input device of the luminaire and to transmit via the bus control commands to the at least one lighting means driver on the basis of the received bus signals from the transceiver.

In particular, the processing unit of the transceiver is configured to convert a received wireless signal into a bus signal, such that the transceiver behaves as an input device of the local lighting system and the bus signal is indicative of an event known by the control unit of the luminaire. Such an event could be "detection by a sensor", such as detection of a user detected by an occupancy sensor" or "actuating (e.g. pressing) of a user interface", such as pressing of at least one push-button. In this case, the luminaire is preferably based on the DALI-2 industry standard, i.e. the luminaire is preferably a DALI-2 luminaire.

That is, in case the received wireless signal causes the transceiver to behave as an occupancy sensor, the processing unit of the transceiver is preferably configured to convert the received wireless signal to a bus signal that is indicative of an event of the sensor, for example "detection of a user by the occupancy sensor". Moreover, in case the received wireless signal causes the transceiver to behave as a push-button device, the processing unit of the transceiver is preferably configured to convert the received wireless signal to a bus signal that is indicative of an event of the push-button device, for example "pressing t one push-button of the push-button device".

The control unit is preferably configured to transmit via the bus control commands to the at least one lighting means driver on the basis of the event indicated by a bus signal received via the bus, in particular from the transceiver. In other words, the control unit may be configured to control the light emission of the luminaire on the basis of the event indicated by a bus signal received via the bus, in particular from the transceiver.

Preferably, the at least one lighting means driver is configured to convert electrical energy, in particular an input voltage or input current, supplied from an external energy source, such as mains, into a different electrical energy level, in particular a higher or lower output voltage or output current. Further, the at least one lighting means driver preferably comprises at least one actively switched DC-to-DC converter with at least one switch, such as a transistor, and at least one electrical energy storage, such as a choke or an activity, wherein an input voltage or current may be converted into a higher or lower output voltage or current, depending on the type of DC-to-DC converter, by actively switching the at least one switch. Examples of an actively switched DC-to-DC converter are a boost converter, a buck converter, a flyback converter, a resonant converter etc.

In case the at least one lighting means driver comprises at least one actively switched DC-to-DC converter, the control unit is configured to control the switching of the at least one switch of the DC-to-DC converter in order to control the electrical energy directly or indirectly provided to the at least one lighting means.

Preferably, the at least one lighting means are one or more LEDs, such as organic LEDs, inorganic LEDs etc., which may be electrically connected in parallel and/or in series. The at least one lighting means is not limited to one or more LEDs, but can alternatively or additionally correspond to other lighting means, such as a fluorescence lamps, compact fluorescent lamps etc.

The control unit is in particular configured to control the light emission by the at least one lighting means by controlling the at least one lighting means driver. In other words, the control unit may be configured to control the light emission of the luminaire. In particular, the control unit may be configured to control the light emission of the luminaire by transmitting one or more bus signals via the bus.

Further, the bus is preferably a data bus. Furthermore, the bus is preferably a wired bus comprising at least one wired line. In particular, the bus is a data bus that is configured to supply the control unit and/or the transceiver with electrical energy.

Moreover, the luminaire preferably comprises an energy supply input configured to be electrically connected to an external energy source, such as mains, for supplying electrical energy to the at least one lighting means driver. In addition, the luminaire preferably comprises a bus power supply unit configured to electrically supply the bus, wherein the energy supply input is preferably configured to supply electrical energy to the bus power supply unit when electrically connected to the external energy source.

Preferably, the luminaire comprises at least one further input device configured to transmit bus signals via the bus to the control unit (besides the transceiver configured to behave as an input device of the luminaire). In case the luminaire is based on the DALI-2 industry standard, the at least one further input device is preferably at least one DALI-2 input device respectively at least one further input device based on the DALI-2 industry standard.

In addition, the control unit is preferably configured to control the at least one lighting means driver on the basis of bus signals received via the bus from the transceiver and the at least one further input device. That is, the control unit is preferably configured to control the light emission by the at least one lighting means by controlling the at least one lighting means driver on the basis of the bus signals received via the bus from the transceiver and the at least one further input device. Namely, by controlling the at least one lighting means driver the control unit is configured to control the electrical energy supplied from the lighting means driver to the at least one lighting means. That is, the control unit may be configured to control the light emission of the luminaire on the basis of bus signals received via the bus from the transceiver and the at least one further input device.

The at least one further input device of the luminaire is preferably a sensor, such as presence and/or movement sensor, configured to transmit bus signals via the bus that are indicative of sensor information. In particular, the at least one further input device of the luminaire is preferably a presence and/or movement sensor configured to transmit bus signals via the bus that are indicative of whether a person is present and/or moves in a vicinity of the sensor.

The at least one further input device, being a sensor, preferably comprises or corresponds to a temperature sensor, occupancy sensor, presence and/or movement sensor, light sensor, humidity sensor etc.

Alternatively, the at least one further input device of the luminaire is preferably an interface, such as a user interface, configured to transmit bus signals via the bus that are indicative of interface information. In particular, the at least one further input device of the luminaire is preferably a user interface, such as a push-button device with one or more push-buttons, configured to transmit bus signals via the bus that are indicative of whether a user has input a command via the user interface, for example, whether a user has pressed at least one push button of the push-button device (being an example of a user interface) or not.

The at least one further input device, being an interface, preferably corresponds to or comprises a user interface such as one or more push buttons, a display with at least one push button, touch display, electro-mechanical switch, dimmer switch etc. The user interface may comprise or correspond to at least one push-button, electro-mechanical switch, on/off switch, dimmer switch, multi-position switch, digital input, analog input, slider control element, rotary control element and/or touch display.

In particular, the at least one further input device, preferably being a DALI-2 input device, is configured to transmit an event to the control unit. Such an event could be "detection by a sensor", such as detection of a user detected by an occupancy sensor or "actuating (e.g. pressing) of a user interface", such as pressing of at least one push-button.

That is, in case the at least one further input device is, for example, an occupancy sensor, the occupancy sensor is preferably configured to transmit via the bus the event "detection of a user" in response to detecting the presence and/or movement of a user. Moreover, in case the at least one further input device is, for example, an push-button device, the push-button device is preferably configured to transmit the event "pressing of a push-button" in response to a push-button of the push-button device being pressed by a user.

In order to achieve the luminaire according to a further aspect of the present invention, some or all of the above described optional features may be combined with each other.

According to a further aspect of the present invention, a lighting system is provided. The lighting system comprises at least one luminaire according to a further aspect of the present invention, as described above, and at least one further luminaire configured to transmit and receive wireless signals, wherein the at least one luminaire is configured to wirelessly communicate with the at least one further luminaire.

Preferably, the lighting system is a global lighting system. In particular, the lighting system is a global lighting system and the at least one luminaire according to a further aspect of the present invention is at least one local lighting system.

The above description with regard to the luminaire according to a further aspect of the present invention is also valid for the at least one luminaire of the lighting system according to a further aspect of the present invention.

In the following, the at least one luminaire according to a further aspect of the present invention is referred to as the at least one luminaire differing from the at least one further luminaire.

Preferably, the at least one luminaire is configured to wirelessly communicate with the at least one further luminaire according to a swarm protocol, in particular an adaptive swarm protocol.

Preferably, the lighting system comprises the at least one luminaire and a plurality of further luminaires configured to wirelessly communicate with each other and the at least one luminaire, wherein each luminaire is configured to receive a wireless signal with a count. In case the count is less than a maximum value, each luminaire is preferably configured to increment the count by one and to transmit to neighboring luminaires the wireless signal with the incremented count, and, in case the count is greater than or equal to a maximum value, each luminaire is preferably configured to ignore the wireless signal.

In particular, the at least one luminaire is configured to wirelessly communicate via the transceiver with the further luminaires of the lighting system. Preferably, the transceiver, in particular its processing unit, is configured to convert a wireless signal into a bus signal demanding the control unit of the luminaire to control the light emission by the luminaire according to information comprised by the wireless signal and indicated by the bus signal, in case the count of the received wireless signal corresponds to a defined count that is less than the maximum value.

As outlined already above, the count of the received wireless signal preferably corresponds to the number of further luminaires of the lighting system via which the wireless signal is transmitted from the original luminaire that originally transmitted the wireless signal. Therefore, the count may be indicative of the distance between the at least one luminaire, in particular the transceiver, and the original luminaire. Namely, the greater the count, the greater the number of further luminaires via which the received wireless signal is transmitted from the original luminaire to the at least one luminaire and, thus, the greater the distance between the at least one luminaire and the original luminaire. That is especially the case when the wireless signal is transmitted by a method that only supports a short range transmission, such as infrared, visible light, ultrasound and/or infrasound transmission, and, thus, allows to transmit a wireless signal only between neighboring luminaires respectively between a luminaire and luminaires within a specific distance of the luminaire. The transceiver, in particular its processing unit, may be configured to determine, on the basis of the count, the distance between the at least one luminaire, in particular the transceiver, and the original luminaire.

In case the at least one luminaire and the further luminaires transmit the wireless signals in the form of visible light, infrared, ultrasound and/or infrasound, the wireless communication may be limited to a room, because visible light, infrared, ultrasound and/or infrasound may not pass walls. This is advantageous, in case the wireless communication of the global lighting system should be limited to luminaires of a room, so that the light emission of only the luminaries of the room may depend on the wireless communication. In this case, the luminaires of the global lighting system correspond to luminaires of a room. Radio signals, such as WLAN signals or Bluetooth signals, are suited less for such an embodiment, because they may pass walls of a room.

Actual input devices that are configured to be electrically connected or are electrically connected with the bus of the luminaire may be classified by the distance between their actual installation position and the control unit. Therefore, when the transceiver receives a wireless signal with a count corresponding to specific distance then the processing unit is preferably configured to convert the received wireless signal into a bus signal, such that the transceiver behaves as an actual input device corresponding to the specific distance. In other words, the processing unit is configured to convert the received wireless signal into the same bus signal(s) that an actual input device corresponding to the specific distance would transmit via the bus to the control unit.

In particular, such a bus signal is indicative of the actual input device corresponding to the specific distance. For example, the greater the specific distance the smaller the dim level communicated by the bus signal. This has the advantage, that in a vicinity of the original luminaire the lighting respectively light intensity by the luminaire will be greater due to the greater dim level communicated by the bus signal transmitted via the bus from the transceiver compared to an area more distant from the original luminaire.

The distance measurement in the lighting system is not limited to a count that is indicative of a specific distance. Alternatively, the wireless signal may comprise a run-time difference that is indicative of a specific distance, in particular run-time difference between sound/ultra-sonic and radio frequency (RF)/light or similar.

In other words, the distance measurement is not limited to be a count corresponding to the number of luminaires of the lighting system via which the wireless signal is transmitted from the original luminaire to the transceiver. There may also be other ways of distance measuring, e.g. based on run time difference between sound/ultra-sonic and radio frequency (RF)/light or similar In order to achieve the lighting system according to a further aspect of the present invention, some or all of the above described optional features may be combined with each other.

According to a further aspect of the present invention, a method for operating a transceiver according to an aspect of the present invention, as described above, is provide. The method comprises the steps of electrically connecting the transceiver to the bus of a local lighting system, and converting by the processing unit received wireless signals into bus signals such that the transceiver behaves as an input device of the local lighting system when electrically connected to the bus.

In case the local lighting system is based on the DALI-2 industry standard, the method preferably comprises the steps of electrically connecting the transceiver to the bus of the local lighting system, and converting by the processing unit of the transceiver received wireless signals into DALI-2 signals respectively DALI-2 bus signals, such that the transceiver behaves as a DALI-2 input device of the local lighting system when electrically connected to the bus.

Therefore, as already mentioned above, according to a further aspect of the present disclosure a method for operating a transceiver according to an aspect of the present invention, as described above, is provide. The method comprises the steps of electrically connecting the transceiver to the bus of a local lighting system, and converting by the processing unit received wireless signals into bus signals, preferably DALI-2 signals, such that the transceiver behaves as an input device, preferably as a DALI-2 input device, of the local lighting system when electrically connected to the bus.

The method preferably comprises the step of detachably connecting the transceiver to the bus of local lighting system.

The above description with regard to the transceiver according to an aspect of the present invention is correspondingly valid for the method according to a further aspect of the present invention.

Preferably, the input device is an occupancy sensor or a user interface. In particular, the input device is a presence and/or movement sensor or a push-button device comprising at least one push-button.

Preferably, the method comprises the further step of converting, by the processing unit of the transceiver, a wireless signal received by the receiver into a bus signal on the basis of at least one parameter of the wireless signal such that the transceiver behaves as an input device out of a group of input devices depending on the at least one parameter.

The at least one parameter is preferably indicative of the distance from the transceiver to the original luminaire of the global lighting system that originally transmitted the wireless signal.

Further, the at least one parameter is preferably a count corresponding to the number of luminaires of the global lighting system via which the wireless signal is transmitted from the original luminaire to the transceiver.

Furthermore, each input device of the group of input devices is preferably configured to transmit bus signals that identify the respective input device as the transmitter of the bus signals Preferably the group of input devices is a group of occupancy sensors and/or user interfaces. In particular the group of input devices is a group of presence and/or movement sensors and/or push-button devices comprising at least one push-button.

Preferably, the method comprises the further steps of monitoring, by the processing unit of the transceiver, the bus of the local lighting system when the transceiver is electrically connected to the bus and controlling, by the processing unit, on the basis of a bus signal, transmitted in the local lighting system via the bus, the transmitter to transmit a wireless signal indicative of the bus signal to the global lighting system.

Further, the method preferably comprises the further steps of filtering, by the processing unit of the transceiver, the received wireless signals according to at least one criterion, such as a priority assigned to the wireless signals, and converting, by the processing unit, only wireless signals fulfilling the at least one criterion into bus signals.

In order to achieve the method according to a further aspect of the present invention, some or all of the above described optional features may be combined with each other.

BRIEF DESCRIPTION OF THE DRAWINGS

In the following, the invention is described exemplarily with reference to the enclosed Figures, in which.

DETAILED DESCRIPTION

Figure 1:
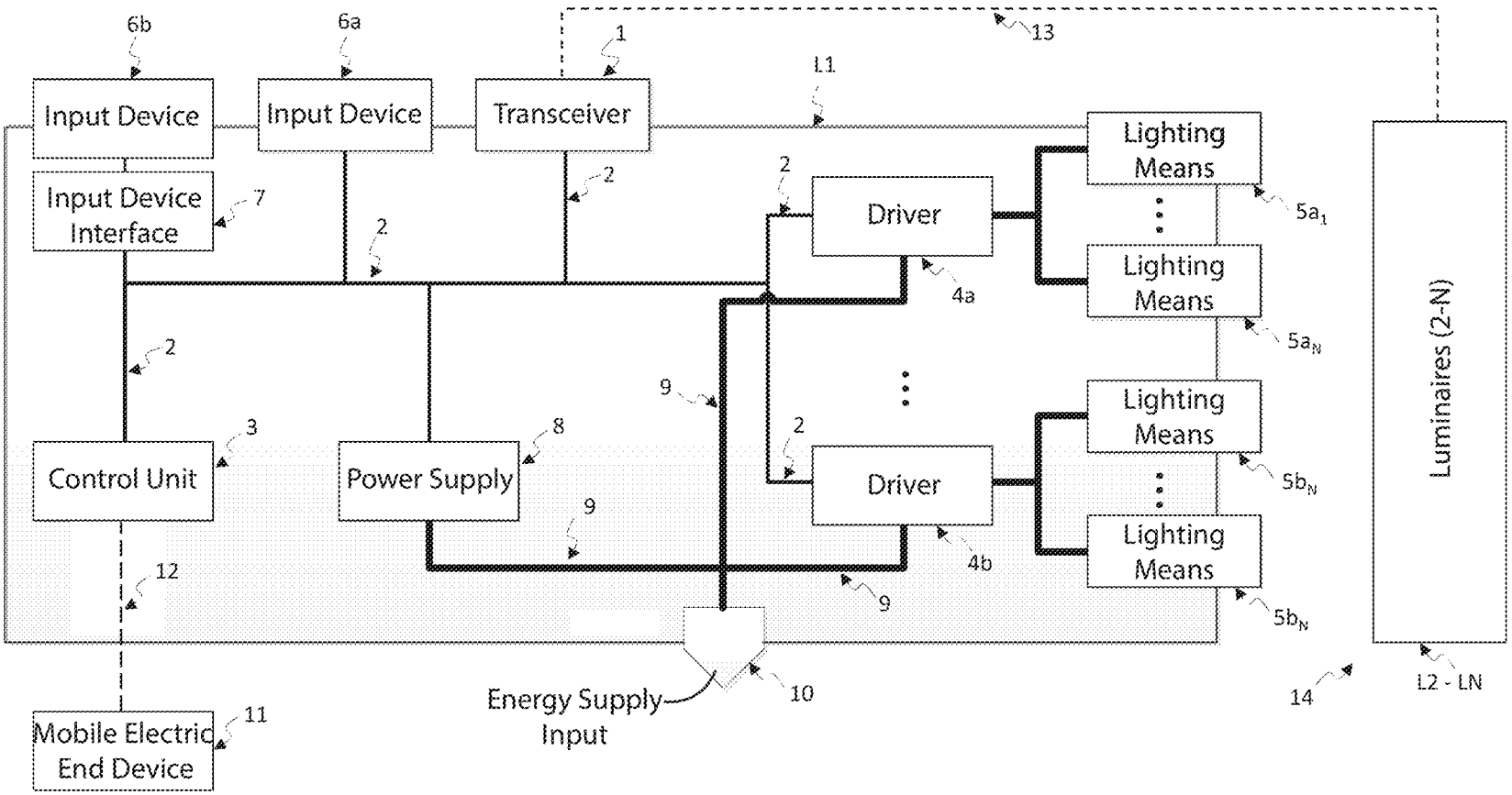
FIG. 1 is a block diagram of a local lighting system, such as a luminaire, according to a preferred embodiment of the present invention.

FIG. 1 is a block diagram of a local lighting system, such as a luminaire, according to a preferred embodiment of the present invention.

The above description with regard to the transceiver according to an aspect of the present invention and the luminaire according to a further aspect of the invention is correspondingly valid for the luminaire and, thus, the transceiver shown in FIG. 1.

The local lighting system L1 is assumed to be a luminaire in the following description of a local lighting system according to a preferred embodiment of the present invention. Nevertheless, a local lighting system according to the present disclosure is not limited to being a luminaire, but may also be for example a lighting of a building.

The luminaire L1 comprises at least a transceiver 1, a bus 2 and a control unit 3. The transceiver 1 and the control unit 3 are electrically connected to the bus 2. The luminaire L1 may further comprise one or more lighting means drivers and for each lighting means driver one or more lighting means. According to FIG. 1, the luminaire L1 comprises, only by way of example, two lighting means drivers 4*a* and 4*b* electrically connected to the bus 2 and a plurality of lighting means $\mathbf{5}a_1$ to $\mathbf{5}a_N$, $\mathbf{5}b_1$ to $\mathbf{5}b_N$. Each of the lighting means drivers 4*a* and 4*b* is configured to electrically supply N lighting means $\mathbf{5}a_1$ to $\mathbf{5}a_N$, $\mathbf{5}b_1$ to $\mathbf{5}b_N$, wherein N is an integer greater than or equal to 1. The lighting means drivers 4*a* and 4*b* may electrically supply a different number of lighting means.

The luminaire L1 further comprises at least one optional input device (actual input device). According to FIG. 1 the luminaire L1 comprises, only by way of example, two optional input devices 6*a* and 6*b*. The input device 6*a* is electrically connected to the bus 2 and the input device 6*b* is electrically connected via an optional input device interface 7 to the bus 2. Moreover, as shown in FIG. 1, the luminaire L1 may comprise an energy supply input 10 configured to be electrically connected to an external energy source, such as mains, for supplying electrical energy via the power line 9 to the two lighting means drivers 4*a* and 4*b*. In addition, the luminaire L1 may comprise a bus power supply unit 8 configured to electrically supply the bus 2, wherein the energy supply input 10 is configured to supply via the power line 9 electrical energy to the bus power supply unit 8 when electrically connected to the external energy source.

Preferably, the luminaire L1 is a DALI-2 luminaire. In this case, the bus 2 and the components of the luminaire L1 electrically connected to the bus 2 are DALI-2 components. In other words, the DALI-2 luminaire L1 comprises two optional DALI-2 input devices 6*a* and 6*b*, one optional DALI-2 input device interface 7, two optional DALI-2 lighting means drivers 4*a* and 4*b* and a DALI-2 bus power supply 8 each electrical connected to the DALI-2 bus 2. The control unit 3 corresponds in such a case to a DALI-2 application controller.

The transceiver 1 is configured to be electrically connected (preferably detachably connected) to the bus 2 of the luminaire L1 in order to incorporate the luminaire L1 into the global lighting system 14 comprising N further luminaires L2 to LN, wherein N is an integer greater than or equal to 1. The transceiver 1 is a transceiver according to an aspect of the present invention, as described above. Therefore, the transceiver 1 is configured to wirelessly communicate with the global lighting system 14, in particular with at least one of the further luminaires L2 to LN of the global lighting system (indicated by the dashed line 13 in FIG. 1). The transceiver 1, in particular the processing unit of the transceiver 1, is configured to convert received wireless signals from the global lighting system 14 into bus signals, such that the transceiver 1 behaves as an input device of the luminaire L1. The transceiver 1 is described in more detail with respect to FIG. 2 below.

The bus 2 is a wired data bus respectively wired communication bus comprising at least one wired line that allows a wired communication between the components of the luminaire L1 electrically connected to the bus 2. In case the bus 2 is a DALI-2 bus the bus allows a communication according to the DALI-2 industry standard.

The bus 2 may be configured to supply the control unit 3, the transceiver 1 and/or the optional input devices 6*a* and 6*b* with electrical energy.

The control unit 3 preferably comprises or corresponds to a processor, microprocessor, controller, microcontroller, application-specific integrated circuit (ASIC) or any combination of these elements.

The control unit 3 is configured to control communication via the bus 2. In particular, the control unit 3 is configured to control light emission of the luminaire L1.

The control unit 3 is configured to receive bus signals via the bus 2 from the components connected to the bus 2, such as the transceiver 1 behaving as an input device of the luminaire L1, the optional input devices 6*a* and 6*b* and/or the lighting means drivers 4*a* and 4*b*. The control unit 3 is also configured to transmit bus signals via the bus 2 to the components electrically connected to the bus 2. The control unit 3 is configured to control the light emission of the luminaire L1 on the basis of bus signals that are transmitted via the bus 2 by the transceiver 1 behaving/emulating an (actual) input device of the luminaire L1 and the input devices 6*a* and 6*b* of the luminaire L1.

Bus signals may be bus commands, such as control commands, or data, such as data measured by a sensor (sensor data). For example the control unit 3 may receive via the bus 2 data from one of the two optional input devices 6*a* and 6*b* and either may transmit these data to another component electrically connected to the bus 2, such as the transceiver 1, or may transmit control commands on the basis of the received data to another component connected to the bus, e.g. to at least one of the lighting means drivers 4*a* and 4*b*.

The transceiver 1 may be configured to understand respectively interpret bus signals transmitted via the bus 2 and to transmit wireless signals based on the interpreted bus signals to the global lighting system 14. In such a case, it is not necessary that the control unit 3 transmits via the bus 2 a control command to the transceiver 1 for triggering the transmission of the wireless signals. In particular, the processing unit 1*c* of the transceiver 1 is configured to monitor the bus 2 of the luminaire L1, to interpret a bus signal transmitted via the bus 2 and to control, without being triggered by a control command from the control unit 1, on the basis of the bus signal the transmitter to transmit a wireless signal indicative of the bus signal to the global lighting system 14.

For example, in case the input devices 6*a* and/or 6*b* transmit bus signals via the bus 2 to the control unit 3, the transceiver 1 is able to directly interpret the bus signals on the bus 2 that are sent from the input devices 6*a* and/or 6*b*, and to transmit wireless signals indicative of the bus signals to the global lighting system 14. As mentioned already above, it is not necessary that the control unit 3 transmits explicit commands to the transceiver 1 to trigger a transmission into the global lighting system 14.

As shown in FIG. 1, the control unit 3 is preferably configured to communicate, in particular transmit and/or receive, information such as commands or data with an external mobile electronic end device 11, such as a mobile phone. This communication is preferably a wireless communication, in particular according to the Bluetooth industry standard, the WLAN industry standard or any other known industry standard for wireless communication (as indicated by the dashed line 12 in FIG. 1). Therefore it is possible for example that a user inputs via an app on his mobile electronic end device, e.g. mobile phone, a desired dim level for setting the light intensity of the light emitted by the luminaire L1 to the control unit 3. The desired dim level is wirelessly transmitted 12 from the mobile electronic end device 11 to the control unit 3 according to e.g. the Bluetooth industry standard.

The control unit 3 may control at least one of the lighting means drivers 4*a* and 4*b* on the basis of the desired dim level and/or transmit a bus signal indicative of the desired dim level via the bus to another component of the luminaire, such as the transceiver 1.

The control unit 3 is configured to control the two lighting means drivers 4*a* and 4*b* on the basis of bus signals received via the bus from the transceiver 1 and/or the two optional input devices 6*a* and 6*b* and/or information received from extern, e.g. from the mobile electronic end device 11. That is, the control unit 3 is configured to control the light emission of the lighting means $\mathbf{5}a_1$ to $\mathbf{5}a_N$ and $\mathbf{5}b_1$ and $\mathbf{5}b_N$ by controlling the lighting means drivers 4*a* and 4*b* on the basis of the bus signals received via the bus from the transceiver 1 and/or the two optional input devices 6*a* and 6*b* and/or information received from extern.

The two lighting means drivers 4*a* and 4*b* are configured to electrically supply the lighting means $\mathbf{5}a_1$ to $\mathbf{5}a_N$ and $\mathbf{5}b_1$ to $\mathbf{5}b_N$ by converting electrical energy, in particular an input voltage or input current, supplied from an external energy source, such as mains, into a different electrical energy level, in particular a higher or lower output voltage or output current. At least one of the two lighting means drivers 4*a* and 4*b* preferably comprises at least one actively switched DC-to-DC converter with at least one switch, such as a transistor, and at least one electrical energy storage, such as a choke or an activity. An input voltage or current may be converted by such an actively switched DC-to-DC converter into a higher or lower output voltage or current, depending on the type of DC-to-DC converter, by actively switching the at least one switch. Examples of an actively switched DC-to-DC converter are a boost converter, a buck converter, a flyback converter, a resonant converter etc.

In case one of the two lighting means drivers 4*a* and 4*b* comprises at least one actively switched DC-to-DC converter, the control unit 3 is configured to control the switching of the at least one switch of the DC-to-DC converter in order to control the electrical energy provided by the DC-to-DC converter.

The lighting means $\mathbf{5}a_1$ to $\mathbf{5}a_N$ and $\mathbf{5}b_1$ to $\mathbf{5}b_N$ comprise or correspond to one or more LEDs, such as organic LEDs, inorganic LEDs etc., which may be electrically connected in parallel and/or in series. The lighting means of the luminaire L1 are not limited to LEDs, but can alternatively or additionally correspond to other lighting means, such as a fluorescence lamps, compact fluorescent lamps etc. The two lighting means drivers 4*a* and 4*b* may electrically supply a different number of lighting means. The lighting means supplied by a lighting means driver may be differently or of the same type.

As already outlined above, the luminaire, L1 according to FIG. 1 comprises by way of example two input devices 6*a* and 6*b*. Nevertheless, the luminaire L1 may also comprise only one input device or more than two input devices.

The input device 6*a* is a sensor configured to transmit bus signals via the bus to the control unit 3 that are indicative of sensor information, in particular indicative of measurements results of the sensor. The input device 6*a* preferably comprises or corresponds to a temperature sensor, occupancy sensor, presence and/or movement sensor, light sensor or humidity sensor.

In particular, the input device 6*a* of the luminaire L1 is a presence and/or movement sensor configured to transmit bus signals via the bus 2 that are indicative of whether a person is present and/or moves in a vicinity of the sensor 6*a*.

The input device 6*b* of the luminaire L1 is preferably an interface, such as a user interface, configured to transmit bus signals via the bus 2 to the control unit that are indicative of interface information. The input device 6*b* preferably comprises or corresponds to a user interface such as one or more push buttons, a display with at least one push button, touch display, electro-mechanical switch, dimmer switch etc. The user interface may comprise or correspond to at least one push-button, electro-mechanical switch, on/off switch, dimmer switch, multi-position switch, digital input, analog input, slider control element, rotary control element and/or touch display.

For example, the input device 6*b* of the luminaire L1 is a user interface in form of one or more push buttons configured to transmit bus signals via the bus that are indicative of whether a user has pressed any one of the one or more push buttons or not and, thus, on whether a user has input a command by pressing one or more push buttons. As shown in FIG. 1, the luminaire L1 may comprise optionally an input device interface 7 that is configured to provide a bus signal to the bus 2 on the basis of information from extern input to the input device 6*b* being an interface, in particular a user interface.

The energy supply input 10 is configured to be electrically connected to an external energy source, such as mains or a battery (preferably rechargeable), for supplying electrical energy via the power line 9 to the lighting means drivers 4*a* and 4*b* and the bus power supply unit 8. The bus power supply unit 8 is configured to electrically supply the bus 2 starting from electrical energy supplied via the power line 9 from the energy supply input 10.

Figure 2:
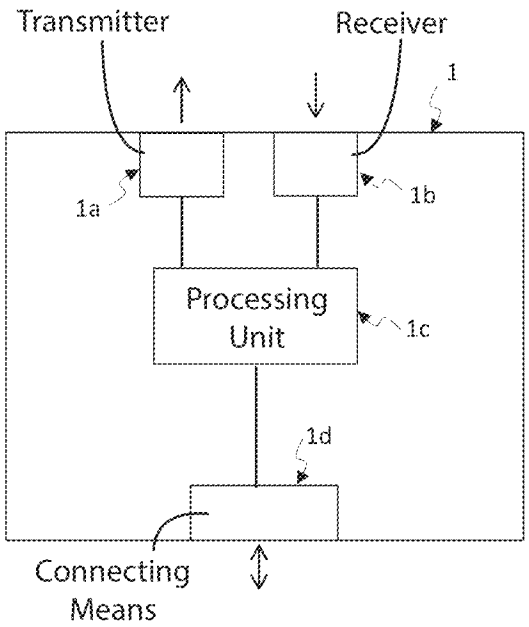
FIG. 2 is a block diagram of a transceiver according to a preferred embodiment of the present invention.

FIG. 2 is a block diagram of a transceiver according to a preferred embodiment of the present invention.

The above description with regard to the transceiver according to an aspect of the present invention and with regard to the transceiver of the luminaire shown in FIG. 1 is correspondingly valid for the transceiver shown in FIG. 2.

The transceiver 1 shown in FIG. 2 corresponds to the transceiver 1 of the luminaire L1 shown in FIG. 1.

The transceiver 1 comprises a transmitter 1*a*, a receiver 1*b* and a processing unit 1*c*. The transceiver 1 may also comprise connecting means 1*d* for electrically connecting the transceiver 1, in particular the processing unit 1*c*, to the bus 2 of the luminaire 1.

The transceiver 1 may be a modular element respectively a separate module that is configured to be detachably connected to the luminaire L1, in particular to the bus 2 of the luminaire L1.

The transmitter 1*a* of the transceiver 1 is configured for a wireless communication with the luminaires L2 to LN of the global lighting system 14. The transmitter 1*a* is an infrared transmitter. However, the transmitter 1*a* is not limited to an infrared transmitter. Additionally or alternatively, the transmitter may comprise or correspond to an ultrasonic transmitter, a visible light transmitter, an infrasound transmitter, a radio transmitter and/or any other known transmitter. In case the transmitter 1*a* is a radio transmitter, it may be configured to transmit the wireless signals according to the Bluetooth industry standard, the WLAN industry standard and/or any other known industry standard for radio communication.

The receiver 1*b* of the transceiver 1 is configured for a wireless communication with the luminaires L2 to LN of the global lighting system 14. The receiver 1*b* is an infrared receiver. However, the receiver 1*b* is not limited to an infrared receiver. Additionally or alternatively, the receiver 1*b* may comprise or correspond to an ultrasonic receiver, a visible light receiver, an infrasound receiver, a radio receiver and/or any other known receiver. In case the receiver 1*b* is a radio receiver, it may be configured to receive wireless signals according to the Bluetooth industry standard, the WLAN industry standard and/or any other known industry standard for radio communication.

The processing unit 1*c* comprises or corresponds to a processor, microprocessor, controller, microcontroller, application-specific integrated circuit (ASIC) or any combination of these elements.

The receiver 1*b* is configured to provide received wireless signals to the processing unit 1*c* and the processing unit 1*c* is configured to control the transmitter 1*a* to transmit wireless signals.

The processing unit 1*c* of the transceiver 1 is configured to convert the received wireless signals into bus signals such that the transceiver 1 behaves as an input device of the luminaire L1 (local lighting system) when the transceiver 1 is electrically connected to the bus. The processing unit 1*c* is configured to transmit the bus signals via the bus 2 of the luminaire L1 to the control unit 3 of the luminaire L1.

In response to a wireless signal, received by the receiver 1*b*, from the global lighting system 14, the processing unit 1*c* may be configured to communicate a message, such as a push message, via the bus 2 of the luminaire L1 in the form of one or more bus signals of an (actual) input device, such as the input device 6*a* or 6*b*, of the luminaire L1. Said message (push-message) may comprise an indication of the received wireless signal and/or information comprised by the received wireless signal. Because the processing unit communicates the message in the form of one or more bus signals of an (actual) input device of the luminaire L1, the message does not differ from a message communicated by an (actual input device) of the luminaire L1 via the bus 2.

Since the transceiver 1 is configured to behave as an input device of the luminaire L1, there is no difference for the control unit 3 of the luminaire L1 between the transceiver 1 and an actual input device of the luminaire L1, such as the input devices 6*a* or 6*b*. That is, the control unit 3 receives via the bus 2 bus signals from the transceiver 1 that it could also receive from an actual input device. This is advantageous, as the transceiver 1 allows the luminaire L1 to be incorporated into the global lighting system 14, in particular to communicate with the luminaires L2 to LN of the global system 14, without the need of adapting the communication via the bus 2 within the luminaire L1.

That is, the transceiver 1 is configured to emulate an actual input device of the luminaire 1 and, thus, may also be referred to as a virtual input device or artificial input device of the luminaire L1.

Preferably, the processing unit 1*c* is configured to convert a wireless signal received by the receiver 1*b* into a bus signal on the basis of at least one parameter of the wireless signal, such that the transceiver 1 behaves as an input device out of a group of input devices depending on the at least one parameter. The at least one parameter of the wireless signal is indicative of the distance from the transceiver 1 to the original luminaire of the global lighting system 14 that originally transmitted the wireless signal.

In such a case, the transceiver 1 is preferably configured to behave as an input device out of a group of input devices that corresponds to the distance from the transceiver 1 to the original luminaire of the global lighting system 14 that originally transmitted the wireless signals. Preferably, each input device of the group of input devices is linked to a distance or distance range and the processing unit 1*c* chooses on the basis of the at least one parameter of the received wireless signal which of the group of input devices the transceiver 1 is to behave as.

The transceiver 1, in particular the processing unit 1*c*, is configured to store the association information of the input devices and the respective associated distance or distance range in a storage unit, in particular in a look-up table, from which it can also read the stored data. The storage unit may be a part of the processing unit 1*c* or electrically connect with it (not shown in FIG. 2). The processing unit 1*c* of the transceiver 1 is configured to receive that association via the bus 2 of the luminaire L1 when the transceiver 1 is electrically connected to the bus 2. In particular, the processing unit 1*c* is configured to receive that association information during configuration in a configuration of the transceiver 1 via the bus 1 of the luminaire L1.

Additionally or alternatively, that association information may be already stored in the storage before connecting the transceiver 1 to the local luminaire L1, for example by a user. Additionally or alternatively, that association information may be communicated to the transceiver from extern, for example by a user.

The processing unit 1*c* is configured to understand at least some bus commands such as commands for addressing and configuring the luminaire L1. That is, the processing unit 1*c* is preferably configured to interpret respectively evaluate at least some bus commands of the luminaire L1 and, thus, to react thereto, accordingly. For example, the processing unit 1*c* is configured to be assigned an address via the bus and/or to be configured via the bus 2 in a configuration process, when the transceiver 1 is electrically connected to the bus 2 of the luminaire 1, in particular at the time when the transceiver 1 is electrically connected to the bus 2.

The at least one parameter may be a count corresponding to the number of luminaires $L_2$-$L_N$ of the global lighting system 14 via which the wireless signal is transmitted from the original luminaire to the transceiver 1.

Preferably, the processing unit 1*c* is configured to convert a wireless signal received by the receiver 1*b* into a bus signal on the basis of at least one parameter (count) of the wireless signal such that the transceiver 1 behaves as an occupancy sensor or a push button device with at least one push-button out of a group of occupancy sensors and/or push-button devices with at least one push button, in particular as a presence and/or movement sensor out of a group of presence and/or movement sensors, depending on the at least one parameter.

The processing unit 1*c* of the transceiver 1 may also be configured to monitor the bus 2 of the luminaire L1 and to control on the basis of a bus signal, transmitted in the local lighting system via the bus, the transmitter 1*a* to transmit a wireless signal indicative of the bus signal to the global lighting system 14.

This has the advantage, that information such as control commands or data transmitted via the bus 2 in the luminaire L1 (local lighting system) can be provided to the global lighting system 14. As a result, not only the luminaire L1 may be controlled based on information provided from the global lighting system 14 but also the global lighting system 14 may be controlled based on information provided from the luminaire L1.

The processing unit 1*c* of the transceiver 1 may also be configured to filter the received wireless signals according to at least one criterion, such as a priority assigned to the wireless signals, and to convert only wireless signals fulfilling the at least one criterion into bus signals.

Preferably, the transceiver 1, in particular the processing unit 1*c*, is configured to wirelessly communicate with the luminaires L2 to Ln of the global lighting system 14 according to a swarm protocol. Such a communication will be described below with respect to FIG. 4.

Figure 3:
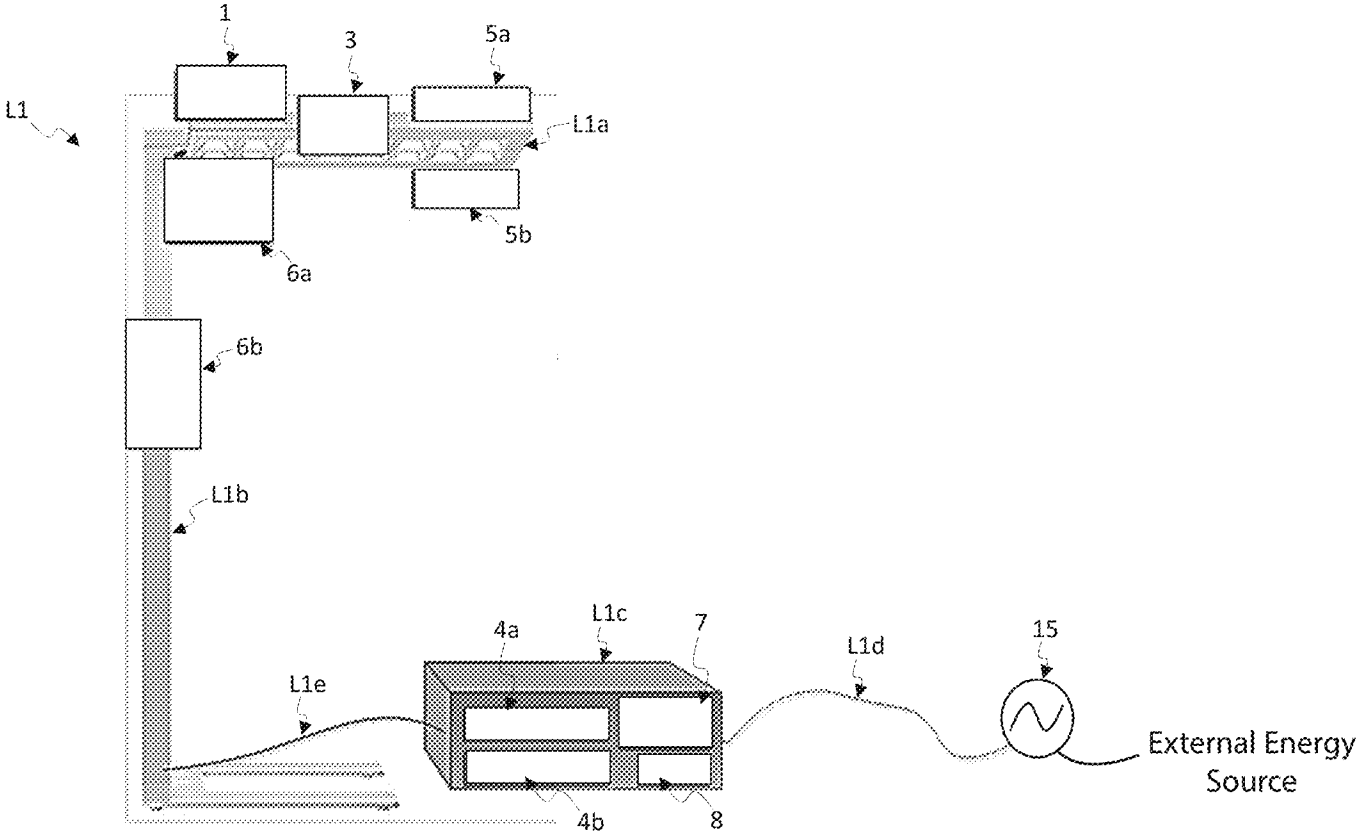
FIG. 3 is a schematic side view of a luminaire according to a preferred embodiment of the present invention.

FIG. 3 is a schematic side view of a luminaire L1 according to an embodiment of the present invention.

FIG. 3 exemplarily shows how the components of the luminaire L1 according to FIG. 1 may be arranged in a luminaire, in particular, in a free-standing luminaire for illuminating, for example, a working desk in an office.

The luminaire L1 comprises a luminaire stand L1*b*, a luminaire head L1*a*, an energy supply unit L1*c* and cables L1*d*, L1*e*.

The luminaire stand L1*b* only comprises the user interface 6*b*, such as one or more push buttons, and, thus, can be very slim. The luminaire head L1*a* comprises the sensor 6*a*, which, for example, corresponds to or comprises a motion and/or presence sensor and light sensor, which is pointing down in the direction of the working desk. The luminaire head L1*a* further comprises two lighting means 5*a* and 5*b*, wherein one 5*b* is pointing down in the direction of the working desk for illuminating the working desk and the other is pointing up in the opposite direction for illuminating the ceiling. In addition, the luminaire head L1*a* comprises the control unit 3 and the transceiver 1.

The energy supply unit L1*c* comprises the two lighting means drivers 4*a* and 4*b* for electrically supplying the two lighting means 5*a* and 5*b*, the input device interface 7 and the bus power supply unit 8. Electrical power may be supplied from an external energy source 15, such as mains, via the electric cable L1*d* to the energy supply unit L1*c* and then from the energy supply unit L1*c* via the electric cable L1*e* to the other components of the luminaire L1.

Figure 4:
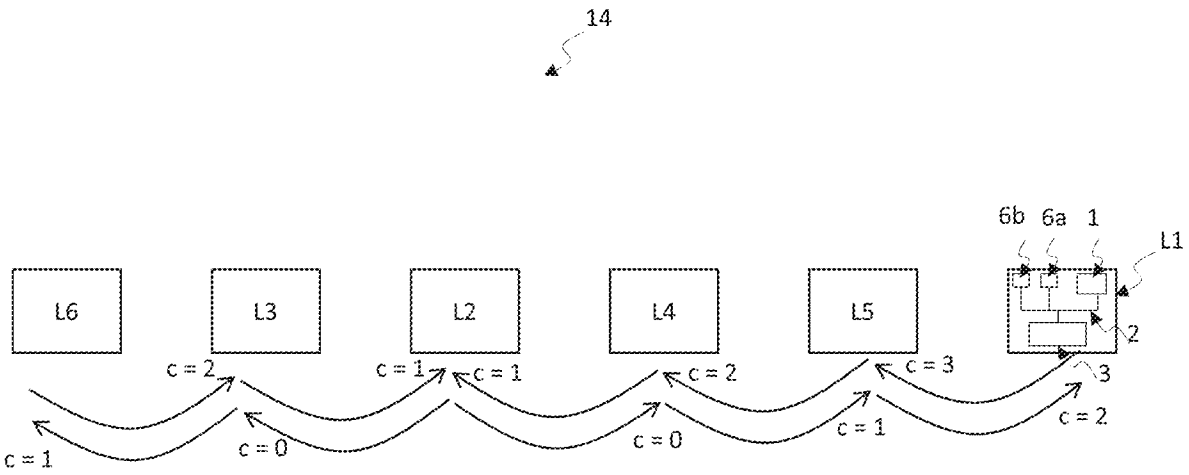
FIG. 4 is a schematic plan of a global lighting system according to a preferred embodiment of the present invention In FIGS. 1 to 4 corresponding elements are marked with the same reference signs.

FIG. 4 is a schematic plan of a global lighting system according to a preferred embodiment of the present invention.

As shown in FIG. 4, the global lighting system 14 comprises one luminaire L1 according to an aspect of the present invention, which corresponds to a local lighting system. The luminaire L1 of FIG. 4 corresponds to the luminaire L1 shown in FIG. 1. Therefore, the above description with respect to the luminaire according to a further aspect of the present invention and the above description with respect to the luminaire L1 of FIG. 1 is also valid for the luminaire L1 shown in FIG. 4.

In FIG. 4 the transceiver 1, the bus 2, the control unit 3 and the two optional input devices 6*a* and 6*b* of the luminaire L1 are shown.

The transceiver 1 of the luminaire L1 of FIG. 4 corresponds to the transceiver 1 shown in FIGS. 1 and 2 and, thus, the description with respect to the transceiver according to an aspect of the present invention as well as the description with respect to the transceiver 1 of FIGS. 1 and 2 is also valid for the transceiver 1 of FIG. 4.

The global lighting system 14 comprises five further luminaires L2, L3, L4, L5 and L6 besides the luminaire L1. Each of these luminaires may be a luminaire according to a further aspect of the present invention. The global lighting system 14 may also comprise at least one or more further luminaires, that is the number of further luminaires shown in FIG. 4 is only by way of example.

The further luminaires L2 to L6 and the luminaire L1 are configured to wirelessly communicate with each other. The luminaire L1 is configured to wirelessly communicate with the further luminaires L2 to L6 of the global lighting system 14 via the transceiver 1, as outlined already above. The transceiver 1 of the luminaire L1 and the further luminaires L2 to L6 are configured to communicate with each other according to a swarm protocol.

For the description of such a communication it is assumed that the luminaires L1 to L6 are configured to wirelessly communicate with each other using infrared radiation. That is, each of the luminaires L2 to L6 has an infrared transmitter and an infrared receiver, and with respect to the luminaire L1 the transmitter 1*a* of the transceiver 1 is an infrared transmitter and the receiver 1*b* of the transceiver 1 is an infrared receiver. Nevertheless, the wireless communication between the luminaires L1 to L6 may also be differently implemented, for example, using a radio communication, such as Bluetooth or WLAN, visible light, infrasound or ultrasound.

A wireless communication between the transceiver 1 of the luminaire L1 and the further luminaires L2 to L6 according to a swarm protocol is not limited to an infrared communication. Other known methods may also be implemented, for example, a communication according to a swarm protocol may be implemented using ultrasonic communication and time-of-flight measurement for distance determination. In particular, a communication according to a swarm protocol may also be implemented using instead of a count (counting of hops) as a distance measurement other known ways of distance measuring, for example, based on run-time difference between sound/ultra-sonic and radio frequency (RF)/light or similar ones. That is, a wireless communication between the transceiver 1 of the luminaire L1 and the further luminaires L2 to L6 may be done according to any known swarm protocol.

A swarm protocol is now exemplarily explained assuming that the luminaire L2 (original luminaire) originally transmits a wireless signal, for example, indicative of the presence of a user in the vicinity of the luminaire L2, to the other luminaires. In particular, the luminaire L2 originally transmits a wireless signal in the case of an event causing a light emission by the luminaire L2. Such an event may be an occupancy sensor of the luminaire L2 detecting presence and/or motion of a person in the vicinity of the luminaire L2 or a user commanding, via a user interface of the luminaire L2, the luminaire L2 to emit light. Therefore, the wireless signal transmitted by the luminaire L2 as well as the wireless signals retransmitted by the other luminaires and the transceiver 1 of the global lighting system 14 may be indicative of the event causing the light emission by the luminaire L2.

Since the range of transmission using infrared light is limited, only the neighboring luminaires L3 and L4 of the luminaire are able to receive the wireless signal from the original luminaire L2. That is, only luminaires within a specific distance, determined by the transmission range of infrared light, around the original luminaire are able to receive the wireless signal. This is also valid in case of using visible light, infrasound or ultrasound for transmitting wireless signals. The wireless signal comprises a count c that is indicative of the number of luminaires via which the wireless signal has been transmitted starting from the original luminaire L2. Therefore, the count c of the wireless signal received by the luminaires L3 and L4 equals to zero (c=0).

The luminaires L3 and L4 are configured to receive the wireless signal with count c equaling to zero (c=0), to increment the count c by one (c=0+1) and to forward the wireless signal with the incremented count c (c=1). As a result, the luminaires L6 and L2 arranged within the specific distance around the luminaire L3 receive the wireless signal with the incremented count c equaling to 1 (c=1) from the luminaire L3, in the example. The luminaires L5 and L2 arranged within the specific distance around the luminaire L4 also receive the wireless signal with the incremented count c equaling to 1 (c=1) from the luminaire L4.

Each of the luminaires L2 to L6 as well as the transceiver 1 of the luminaire L1 are configured to increment the count of the received wireless signal by one and to transmit the wireless signal with the incremented count. In order not to transmit a wireless single in a loop, each of the luminaires L2 to L6 as well as the transceiver 1 of the luminaire L1 are configured to not increment the count of a received wireless signal by one and, thus, to not transmit the wireless signal with the incremented count, in case the count of the received wireless signal is greater than a wireless signal already transmitted before. Therefore, the luminaire L2 will not increment and transmit the wireless signal with the count c equaling to one (c=1) received from the luminaire L3, because the count c equaling to one is greater than the count equaling to zero (c=0) of the wireless signal originally transmitted from the luminaire L2. The same applies for the wireless signal with the count c equaling to 1 (c=1) received by the luminaire L2 from the luminaire L4.

The above explanation is also valid for the luminaires L5, L6 and the transceiver 1. That is, the luminaire L5 receives the wireless signal with count c equaling to one (c=1) from luminaire L4 and the luminaire L6 receives the wireless signal with count c equaling to one (c=1) from luminaire L3, each of the luminaires L5 and L6 increments the count c of the receive wireless signal by one (c=1+1) and transmits the wireless signal with the incremented count c equaling to two (c=2).

The transceiver 1 of the luminaire L1, in particular the receiver 1*b*, receives the wireless signal with the count c equaling to two (c=2) from the luminaire L5, because the luminaire is arranged within the specific distance around the luminaire L5. The receiver 1*b* provides the processor unit 1*c* of the transceiver 1 with the received wireless signal comprising the count c equaling to two (c=2) and the processor unit 1*c* increments the count c of the received wireless signal by one (c=2+1) and controls the transmitter 1*a* to transmit the wireless signal with the count c equaling to three (c=3) to the global lighting system 14. In other words, the transceiver 1 is configured to retransmit the received wireless signal with a count incremented by one.

In the above exemplarily described wireless communication according to the swarm protocol starting at the luminaire L2 (original luminaire) the wireless signal received by the transceiver 1 of the luminaire L1, in particular, the receiver 1*b*, comprises a count equaling to two (c=2), because the count is indicative of the number of luminaires via which the wireless signal has been transmitted from the original luminaire L2. In the case of the luminaire L1, the wireless signal from the original luminaire L2 has been transmitted via the luminaires L4 and L5.

Preferably, the transceiver 1 of the luminaire L1 and the further luminaires L2 to L6 are each configured to increment the count of a receive wireless signal by one and to transmit to neighboring luminaires the wireless signal with the incremented count, in case the count is less than a maximum value; and to ignore the wireless signal in case the count is greater than or equal to the maximum value. Ignoring a wireless signal may include refraining from transmitting the received wireless signal and/or refraining from using the information transmitted by the wireless signal. For example, in the above described example of the swarm protocol the maximum value could have equal to three or greater.

In case the maximum value would equal to two, the transceiver 1 of the luminaire L1 would ignore the wireless signal with the count c equaling to two (c=2) transmitted from the luminaire L5. That is, the processor unit 1*c* of the transceiver 1 would not control the transmitter to transmit the wireless signal with an incremented count (c=3) and/or would not convert the received wireless signal into a bus signal indicative of the information transmitted by the wireless signal.

A communication by the swarm protocol, as described above, may be used in order to control a lighting in a room (in which the global lighting system is installed for example), such that not only light is emitted by a luminaire, where a user (for example person working at writing desk above which the luminaire is installed) is being detected but also by luminaires that are in a vicinity of the luminaire and, thus, in a vicinity of a user. This is advantageous because it is more comfortable for the user if there is also light in the vicinity and not only at the place of the user, such as the writing desk. The luminaire, where the user is detected is referred below as the primary luminaire. The above described swarm protocol may be referred to as adaptive swarm protocol, because the transceiver 1 of the luminaire L1 and the luminaires L3 to L6 of the global lighting system 14 retransmit the wireless signal initially transmitted from the original luminaire L2. As a result a light emission of the luminaires L1 and L3 to L6 may be automatically controlled in dependence of an event (detecting a person at the luminaire L2) causing a light emission of the original luminaire L2 by the retransmission of the wireless signal initially transmitted by the original luminaire L2 in response to the event. Thus, there is no need of a configuration of the luminaires of the global lighting system 14, in particular of setting fixed groups of luminaires, for controlling the light emission of the luminaires in dependence on an event causing a light emission that occurs at one luminaire.

Preferably, the light emitted by luminaires in a vicinity of the primary luminaire can be emitted at a lower dim level, because in the vicinity a reduced light intensity is sufficient. This has the advantage of saving electrical energy.

When using a swarm protocol, as described above, the dim level can be dependent on the count of the received wireless signal. In this case, the dim level of the light emitted by a luminaire is namely dependent on the distance of the luminaire from the primary luminaire. Preferably, the greater the count the smaller the dim level and, thus, the smaller the amount emitted by the respective luminaire.

In the above described embodiment of a swarm protocol, the luminaire L2 (original luminaire) would corresponds to the primary luminaire and, thus, would transmit light with the highest light intensity, e.g. with 100%, because for example at the installation position of the luminaire L2 a user was detected. The luminaires L3 and L4 would emit light with the same dim level, for example 75%, because the count of the wireless signal received by the luminaires L3 and L4 equals to zero (c=0). The light emitted by the luminaires L6 and L5 would be reduced compared with the light emitted by the luminaires L3 and L4, for example to a dim level of only 50%, because the count received by the luminaires L5 and L6 equaling to one (c=1) is greater than the count (c=0) received by the luminaires L3 and L4. The luminaire L1 preferably would emit light with even a more reduce dim level, for example only 20%.

Namely, the processor unit 1*c* of the transceiver 1 of the luminaire L1 is preferably configured to convert a received wireless signal into a bus signal on the basis of the count (at least one parameter) of the wireless signal, such that the transceiver 1 behaves as an input device of out of a group of input devices of the luminaire 1 depending on the count.

For example, the group of input devices may be a group of motion and/or presence sensors which differ from each other in the dim level that the control unit 1 uses for controlling the lighting means drivers in response to a bus signal received from a respective motion and/or presence sensor detecting a user.

The processing unit 1*c* may be configured to communicate a message via the bus 2 in the form of one or more bus signals (that may be communicated by an (actual) input device of the luminaire L1), wherein the message comprises, depending on the count (at least one parameter), a characteristic value out of a group of characteristic values of a bus protocol of the luminaire L1. The bus protocol is used at the luminaire L1 for the bus communication via the bus 2.

Each characteristic value of the group of characteristic values may be linked to a distance or distance range measured from the luminaire L1, in particular from the control unit 3, the light source of the luminaire L1 or the transceiver 1 connected to the bus 2. That is, the distance of a position to the luminaire L1 may be partitioned in distance steps, wherein the characteristic values may correspond to the distance steps.

In response to receiving the wireless signal comprising a count, the processing unit 1*c* of the transceiver 1 may be configured to choose, on the basis of the count, the characteristic value out of the group of characteristic values that is linked to the distance or distance range corresponding to the distance indicated by the count (i.e. the distance from the transceiver 1 to the original luminaire L2 of the global lighting system 14 that originally transmitted the wireless signal). In addition, the processing unit 1*c* of the transceiver 1 may be configured to communicate a message comprising said chosen characteristic value via the bus 2 to the control unit 1 in the form of one or more bus signals (of an (actual) input device of the luminaire L1). The message may be indicative of the event causing the light emission of the original luminaire L2. In the above described embodiment, the processor unit 1*c* of the transceiver 1 of the luminaire L1, in particular being a DALI-2 luminaire, would convert the received wireless signal from the luminaire L5 into a bus signal on the basis of the count equaling to two (c=2) such that the transceiver emulates (behaves as) an input device that corresponds to the count two (c=2). The bus signal converted by the processor unit 1*c* of the transceiver 1 would be indicative of an event depending on the count two (c=2) and would identify the respective input device being emulated to the control unit 3. Such as bus signal could be "Sensor 1: motion detected" or "Push-button module 2: push-button 3 pressed".

In particular, the processor unit 1*c* may choose, on the basis of the count equaling to two (c=2) of the received wireless signal from the luminaire L5, the characteristic value out of the group of characteristic values that is linked to the distance or distance range corresponding to the distance indicated by the count equaling to two (c=2) and, thus, to the distance from the transceiver 1 to the original luminaire L2 of the global lighting system 14 that originally transmitted the wireless signal. In addition, the processing unit 1*c* of the transceiver 1 may communicate a message comprising said chosen characteristic value via the bus 2 to the control unit 1 in the form of one or more bus signals (of an (actual) input device of the luminaire L1). As a result, there is no difference for the control unit 3 of the luminaire L1 when receiving via the bus 2 a bus signal from an actual input device or receiving the same bus signal via the bus 2 from the transceiver 1 behaving as respectively emulating the actual input device as a result of having received a wireless signal.

The control unit 3 is configured to receive the bus signal indicative of the event and to transmit, according to its configuration, dependent on the event indicated by the bus signal a command via the bus 2 that controls the lighting means drivers to drive the respective lighting means such that they emit light at a dim level caused by the count two (c=2) in the global lighting system 14, for example, dim level of 20%. In particular, the control unit 3 may be configured to receive the chosen characteristic value in the form of the one or more bus signals and control light emission of the lighting means dependent on the chosen characteristic value. As a result, the controlled light emission would be at a dim level caused by the count two (c=2).

An event could be a "detection by a sensor", such as detection of a user detected by an occupancy sensor or "actuating (e.g. pressing) of a user interface", such as pressing of at least one push-button.

That is, in case the received wireless signal causes the transceiver 1 to behave as an occupancy sensor, the processing unit 1*c* of the transceiver 1 is preferably configured to convert the received wireless signal to a bus signal that is indicative of an event of the sensor, for example, "detection of a user by the occupancy sensor". Moreover, in case the received wireless signal causes the transceiver 1 to behave as a push-button device, the processing unit 1*c* of the transceiver 1 is preferably configured to convert the received wireless signal to a bus signal that is indicate of an event of the push-button device, for example, "pressing one push-button of the push-button device".

Using infrared, visible light, infrasound or ultrasound for the wireless communication between the luminaires L2 to L5 and the transceiver 1 of the luminaire L1 results in a limited transmission range. This may be advantageous in case the wireless communication and a control of light emission based on the wireless communication should be limited to a room in which the global lighting system 14 may be installed. Namely, infrared (i.e. infrared transmission), visible light, infrasound or ultrasound may not pass through walls of the room and, thus, the wireless communication based on infrared, visible light, infrasound or ultrasound is limited to the room.

In the light of the above, the luminaire according to a further aspect of the present invention, such as the luminaire L1 shown in FIGS. 1, 3 and 4, may be incorporated into a global lighting system, such as the global lighting system 14 shown in FIGS. 1 and 4, as a result of electrically connecting to the luminaire a transceiver according to an aspect of the present invention, such as the transceiver 1 shown in FIGS. 1 to 4. The transceiver allows a communication between the luminaire, an example of a local lighting system using a bus for communication, with an existing global lighting system without the need of adapting the communication via the bus within the luminaire. Namely, the transceiver is configured to convert received wireless signals from the global lighting system into bus signals to be transmitted via the bus of the luminaire, such that the transceiver emulates respectively behaves as an input device of the luminaire. Therefore, there is no difference for the control unit of the luminaire between a communication via the bus with an actual input device of the luminaire and a communication via the bus with the transceiver emulating respectively behaving as an input device of the luminaire.

The invention claimed is:

1. A transceiver (1) for a local lighting system (L1) comprising a bus (2), at least one luminaire, a driver for the luminaire connected to the bus, and a control unit (3) electrically connected to the bus (2) for controlling communication via the bus (2), wherein the transceiver (1) comprises a transmitter (1*a*) configured to transmit short-range wireless signals to a global lighting system (14) comprising one or more luminaires (L2 . . . LN), a receiver (1*b*) configured to receive short-range wireless signals from the global lighting system (14), and a processing unit (1*c*) configured to process the received wireless signals from the global lighting system (14); wherein the transceiver (1) is configured to be electrically connected to the bus (2) of the local lighting system (L1), and the processing unit (1*c*) on the transceiver (1) is configured to convert the short-range wireless signals received from the global lighting system into bus signals, such that the transceiver (1) behaves as an input device of the local lighting system (L1) when electrically connected to the bus (2).

2. The transceiver (1) according to claim 1, wherein the processing unit (1*c*) is configured to convert a wireless signal received by the receiver (1*b*) into a bus signal on the basis of at least one parameter of the wireless signal such that the transceiver (1) behaves as an input device out of a group of input devices depending on the at least one parameter.

3. The transceiver (1) according to claim 2, wherein the at least one parameter is indicative of the distance from the transceiver (1) to the original luminaire of the global lighting system (14) that originally transmitted the wireless signal.

4. The transceiver (1) according to claim 2, wherein the at least one parameter is a count corresponding to the number of luminaires of the global lighting system (14) via which the wireless signal is transmitted from the original luminaire to the transceiver (1).

5. The transceiver (1) according to-claim 2, wherein each input device of the group of input devices is configured to transmit bus signals that identify the respective input device as the transmitter of the bus signals.

6. The transceiver (1) according to claim 1, wherein the wireless signal comprising a count corresponding to the number of luminaires of the global lighting system (14) via which the wireless signal is transmitted from the original luminaire to the transceiver (1), and the processing unit (1*c*) is configured to determine, on the basis of the count, the distance from the transceiver (1) to the original luminaire of the global lighting system (14) that originally transmitted the wireless signal.

7. The transceiver (1) according to claim 1, wherein the input device is an occupancy sensor, or a user interface comprising at least one push-button.

8. The transceiver (1) according to claim 1, wherein the processing unit (1*c*) is configured to monitor the bus (2) of the local lighting system (L1) when the transceiver (1) is electrically connected to the bus (2) and to control on the basis of a bus signal, transmitted in the local lighting system (L1) via the bus (2), the transmitter (la) to transmit a wireless signal indicative of the bus signal to the global lighting system (14).

9. The transceiver (1) according to claim 1, wherein the processing unit (1*c*) is configured to filter the received wireless signals according to at least one criterion, such as a priority assigned to the wireless signals, and to convert only wireless signals fulfilling the at least one criterion into bus signals.

10. A luminaire (L1), comprising a DALI-2 bus, a DALI-2 application controller electrically connected to the bus (2) and configured to control communication via the bus (2), and the transceiver (1) according to claim 1 electrically connected to the bus (2).

11. The luminaire (L1) according to claim 10, further comprising at least one lighting means driver (4*a*, 4*b*) for driving at least one lighting means ($\mathbf{5}a_1 \ldots \mathbf{5}a_N$, $\mathbf{5}b_1 \ldots \mathbf{5}b_N$) comprising at least one LED driver for driving at least one LED;

wherein the control unit (3) is configured to receive bus signals via the bus (2) from the transceiver (1) behaving as an input device of the luminaire (L1) and to transmit via the bus (2) control commands to the at least one lighting means driver (4*a*, 4*b*) on the basis of the received bus signals from the transceiver (1).

12. The luminaire (L1) according to claim 10, wherein the bus (2) is a data bus is configured to supply the control unit (3) and/or the transceiver (1) with electrical energy, and the bus (2) is a wired bus comprising at least one wired line.

13. The luminaire (L1) according to claim 10, comprising at least one further input device (6*a*, 6*b*), configured to transmit bus signals via the bus (2) to the control unit (3), wherein the control unit (3) is configured to control the at least one lighting means driver (4*a*, 4*b*) on the basis of the bus signals received via the bus (2) from the transceiver (1) and the at least one further input device (6*a*, 6*b*).

14. A global lighting system (14) comprising at least one luminaire (L1) according to claim 10, and at least one further luminaire (L2 . . . LN) configured to transmit and receive wireless signals, wherein the at least one luminaire (L1) is configured to wirelessly communicate with the at least one further luminaire (L2 . . . LN).

15. The global lighting system (14) according to claim 14, wherein the at least one luminaire (L1) is configured to wirelessly communicate with the at least one further luminaire (L2 . . . LN) according to a swarm protocol.

16. A method for operating a transceiver (1) according to claim 1 comprising the steps of electrically connecting the transceiver (1) to the bus (2) of a local lighting system (L1), and converting by the processing unit (1*c*) received wireless signals into DALI-2 bus signals, such that the transceiver (1) behaves as a DALI-2 input device of the local lighting system (L1) when electrically connected to the bus (2).

17. The transceiver (1) according to claim 1, wherein the bus is a DALI-2 bus, the control unit (3) is a DALI-2 application controller, the bus signals are DALI-2 signals, and the transceiver (1) behaves as a DALI-2 input device.

18. The transceiver (1) according to claim 1 wherein the receiver (1*b*) is an infrared receiver.

19. The transceiver (1) according to claim 1 wherein the transmitter (1*a*) is an infrared transmitter.

20. The transceiver (1) according to claim 1 wherein the transmitter (1*a*) broadcasts transmitted wireless signals.

21. The transceiver (1) according to claim 1 wherein the transceiver is modular and detachably connected to the bus of the local lighting system and configured to have electrical power supplied by the bus when attached to the bus of the local lighting system.

22. The transceiver (1) according to claim 1 wherein the short-range wireless signals are one of: infrared signals, visible light signals, Bluetooth signals, WLAN wi-fi signals, ultrasonic signals and infrasound signals.

* * * * *